US010765901B2

(12) United States Patent
Radcliffe et al.

(10) Patent No.: US 10,765,901 B2
(45) Date of Patent: Sep. 8, 2020

(54) PROGRAMMABLE RANGE OF MOTION SYSTEM

(71) Applicant: T-Rex Investment, Inc., Atlanta, GA (US)

(72) Inventors: Jeffrey Scott Radcliffe, Marietta, GA (US); Eduardo M. Marti, Weston, FL (US); Robert T. Kaiser, South Hampton, NJ (US)

(73) Assignee: T-REX Investment, Inc., Atlanta, GA (US)

( * ) Notice: Subject to any disclaimer, the term of this patent is extended or adjusted under 35 U.S.C. 154(b) by 8 days.

(21) Appl. No.: 16/218,864

(22) Filed: Dec. 13, 2018

(65) Prior Publication Data

US 2019/0111299 A1 Apr. 18, 2019

Related U.S. Application Data

(60) Continuation-in-part of application No. 16/121,783, filed on Sep. 5, 2018, now Pat. No. 10,293,198, which
(Continued)

(51) Int. Cl.
*A63B 21/00* (2006.01)
*A61H 1/02* (2006.01)
(Continued)

(52) U.S. Cl.
CPC ..... *A63B 21/00178* (2013.01); *A61H 1/0281* (2013.01); *A63B 21/0023* (2013.01);
(Continued)

(58) Field of Classification Search
CPC ..... A63B 21/00178; A63B 21/4035; A63B 21/0023; A63B 23/03508; A63B 23/1254;
(Continued)

(56) References Cited

U.S. PATENT DOCUMENTS 4,185,818 A * 1/1980 Brentham ..... A63B 21/0083 482/112
4,407,496 A 10/1983 Johnson
(Continued)

FOREIGN PATENT DOCUMENTS

| | | |
|---|---|---|
| DE | 102008053410 | 4/2010 |
| KR | 20130025311 | 3/2013 |
| WO | 2015058249 | 4/2015 |

OTHER PUBLICATIONS http://completeorthopedicservices.com/main/?slide=slide-3.
(Continued)

*Primary Examiner* — Garrett K Atkinson
(74) *Attorney, Agent, or Firm* — David L. King

(57) ABSTRACT

A programmable range of motion system has a frame, a range of motion device, a controller, a computer and sensors. The frame has a seat to support a rehab patient. The range of motion device is attached to the frame. The actuator, servo or alternate mechanism selectively rotates the range of motion device through a range of motion for a rehab patient's limb. The controller controls the actuator, servo or alternate mechanism. The computer is connected electronically to the controller. The computer has a software, program or application including a plurality of programmable range of motion movements for exercising the limb. The sensor detects movements of the actuator, servo or alternate mechanism and records data back to the computer. The term actuator as used hereafter includes servo or alternate articulating mechanism.

14 Claims, 29 Drawing Sheets

Related U.S. Application Data is a division of application No. 14/837,280, filed on Aug. 27, 2015, now Pat. No. 10,220,234, which is a continuation-in-part of application No. 14/730,574, filed on Jun. 4, 2015, now Pat. No. 9,669,249.

(60) Provisional application No. 62/134,633, filed on Mar. 18, 2015, provisional application No. 62/042,399, filed on Aug. 27, 2014, provisional application No. 62/007,541, filed on Jun. 4, 2014.

(51) Int. Cl.

| | |
|---|---|
| ***A63B 21/002*** | (2006.01) |
| ***A63B 23/035*** | (2006.01) |
| ***A63B 23/12*** | (2006.01) |
| ***A63B 24/00*** | (2006.01) |
| ***A63B 71/00*** | (2006.01) |

(52) U.S. Cl.

CPC .... *A63B 21/00181* (2013.01); *A63B 21/4017* (2015.10); *A63B 21/4021* (2015.10); *A63B 21/4035* (2015.10); *A63B 21/4047* (2015.10); *A63B 21/4049* (2015.10); *A63B 23/03508* (2013.01); *A63B 23/1245* (2013.01); *A63B 23/1254* (2013.01); *A63B 23/1263* (2013.01); *A63B 23/1272* (2013.01); *A63B 24/0087* (2013.01); *A61H 2201/018* (2013.01); *A61H 2201/0184* (2013.01); *A61H 2201/123* (2013.01); *A61H 2201/1616* (2013.01); *A61H 2201/1633* (2013.01); *A61H 2201/1659* (2013.01); *A61H 2201/1676* (2013.01); *A61H 2201/501* (2013.01); *A61H 2201/5046* (2013.01); *A61H 2201/5061* (2013.01); *A61H 2201/5069* (2013.01); *A61H 2201/5097* (2013.01); *A61H 2203/0431* (2013.01); *A63B 2024/0093* (2013.01); *A63B 2071/0072* (2013.01); *A63B 2071/0081* (2013.01); *A63B 2208/0233* (2013.01); *A63B 2220/17* (2013.01); *A63B 2220/24* (2013.01); *A63B 2220/51* (2013.01); *A63B 2225/20* (2013.01); *A63B 2225/50* (2013.01)

(58) Field of Classification Search

CPC ..... A63B 23/1263; A63B 23/1272; A63B 24/0087; A63B 21/00181; A63B 21/4017; A63B 21/4021; A63B 21/4049; A63B 21/4047; A63B 23/1245; A63B 2024/0093; A63B 2071/0072; A63B 2071/0081; A63B 2208/0233; A63B 2220/17; A63B 2220/24; A63B 2220/51; A63B 2225/20; A63B 2225/50; A61H 1/0281; A61H 2201/0184; A61H 2203/0431; A61H 2201/5097; A61H 2201/5069; A61H 2201/5061; A61H 2201/5046; A61H 2201/501; A61H 2201/1676; A61H 2201/018; A61H 2201/123; A61H 2201/1616; A61H 2201/1633; A61H 2201/1659; A61H 2201/1671; A61H 2205/06; A61H 2205/10; A61H 2201/0176; A61H 2201/0192; A61H 2201/1215; A61H 2201/1472; A61H 2201/1638; A61H 2201/164; A61H 2201/0149; A61H 1/0237; A61H 1/024; A61H 1/0244; A61H 1/0274

See application file for complete search history.

(56) References Cited

U.S. PATENT DOCUMENTS

| | | | | | |
|---|---|---|---|---|---|
| 4,441,708 | A * | 4/1984 | Brentham | A63B 23/03516 | 482/112 |
| 4,502,681 | A * | 3/1985 | Blomqvist | A63B 21/04 | 482/130 |
| 4,566,692 | A * | 1/1986 | Brentham | A63B 21/0083 | 482/113 |
| 4,628,910 | A | 12/1986 | Krukowski | | |
| 4,691,694 | A * | 9/1987 | Boyd | A63B 21/0058 | 482/5 |
| 4,718,665 | A * | 1/1988 | Airy | A63B 21/015 | 482/119 |
| 4,772,015 | A * | 9/1988 | Carlson | A63B 23/12 | 482/902 |
| 4,776,587 | A * | 10/1988 | Carlson | A63B 23/0494 | 482/134 |
| 4,905,676 | A | 3/1990 | Bond et al. | | |
| 4,930,770 | A | 6/1990 | Baker | | |
| 4,957,281 | A | 9/1990 | Christolear | | |
| 5,020,797 | A * | 6/1991 | Burns | A63B 23/0494 | 482/137 |
| 5,158,074 | A | 10/1992 | Grellas | | |
| 5,163,451 | A * | 11/1992 | Grellas | A61H 1/0274 | 128/898 |
| 5,179,939 | A * | 1/1993 | Donovan | A61H 1/0281 | 482/4 |
| 5,209,223 | A * | 5/1993 | McGorry | A63B 21/00178 | 482/100 |
| 5,280,783 | A * | 1/1994 | Focht | A61H 1/0259 | 601/34 |
| 5,314,390 | A * | 5/1994 | Westing | A63B 21/00178 | 482/111 |
| 5,320,641 | A * | 6/1994 | Riddle | A61H 1/0292 | 5/618 |
| 5,403,251 | A * | 4/1995 | Belsito | A63B 24/00 | 482/4 |
| 5,417,643 | A | 5/1995 | Taylor | | |
| 5,443,444 | A * | 8/1995 | Pruyssers | A61F 5/0123 | 602/16 |
| 5,486,150 | A * | 1/1996 | Randolph | A63B 21/00072 | 482/123 |
| 5,919,148 | A | 7/1999 | Marko | | |
| 5,980,435 | A * | 11/1999 | Joutras | A43B 1/0054 | 482/114 |
| 6,007,500 | A | 12/1999 | Quintinskie | | |
| 6,010,434 | A | 1/2000 | Hodges | | |
| 6,056,675 | A * | 5/2000 | Aruin | A63B 21/0023 | 482/140 |
| 6,301,526 | B1 | 10/2001 | Kim | | |
| 6,872,187 | B1 * | 3/2005 | Stark | A61F 5/0102 | 602/16 |
| 7,695,416 | B2 * | 4/2010 | Weiner | A61H 1/024 | 482/112 |
| 7,833,138 | B1 | 11/2010 | Fulks | | |
| 7,862,524 | B2 | 1/2011 | Carignan et al. | | |
| 7,963,932 | B2 * | 6/2011 | Ashihara | A61F 5/0102 | 601/35 |
| 8,277,396 | B2 * | 10/2012 | Scott | A61B 5/1121 | 600/595 |
| 8,333,722 | B2 * | 12/2012 | Ewing | A61H 1/024 | 482/907 |
| 8,540,652 | B2 * | 9/2013 | Tong | A61H 1/0237 | 600/546 |
| 9,456,951 | B2 | 10/2016 | Stevenot et al. | | |
| 9,744,092 | B2 | 8/2017 | Fu et al. | | |
| 2002/0082530 | A1 | 6/2002 | Knoll | | |
| 2003/0115954 | A1 | 6/2003 | Zemlyakov | | |
| 2004/0243027 | A1 | 12/2004 | Hook | | |
| 2005/0049122 | A1 | 3/2005 | Vallone | | |
| 2005/0272575 | A1 * | 12/2005 | Melegati | A63B 23/1245 | 482/110 |
| 2005/0273022 | A1 * | 12/2005 | Diaz | A61H 1/0259 | 601/5 |

(56) References Cited

U.S. PATENT DOCUMENTS

2006/0040799 A1 2/2006 Pompile
2008/0041153 A1 2/2008 Tokita
2009/0149783 A1 6/2009 Nef et al.
2009/0264799 A1* 10/2009 Bonutti ..... A61H 1/0274 601/5
2010/0130893 A1* 5/2010 Sankai ..... A63B 21/0058 601/5
2010/0145238 A1 6/2010 Stienen et al.
2010/0227741 A1* 9/2010 Rosenberg ..... A61F 5/0123 482/79
2010/0234776 A1 9/2010 Borden
2010/0249673 A1 9/2010 Nef et al.
2011/0251533 A1 10/2011 Han et al.
2012/0232438 A1* 9/2012 Cataldi ..... A63B 21/4045 601/5
2012/0310118 A1 12/2012 Sarver et al.
2012/0330198 A1 12/2012 Patoglu
2013/0060171 A1* 3/2013 Fu ..... A61H 1/02 601/5
2013/0204168 A1* 8/2013 Bombard ..... A61H 1/0244 601/5
2013/0237883 A1 9/2013 Malosio et al.
2013/0245524 A1* 9/2013 Schofield ..... A61F 5/0127 602/16
2014/0094721 A1* 4/2014 Diallo ..... A63B 21/0058 601/5
2014/0336542 A1 11/2014 Fu et al.
2015/0051520 A1* 2/2015 Donohue ..... A61H 1/0266 601/35
2015/0190249 A1* 7/2015 Ishibashi ..... A61H 1/0244 623/24
2015/0265428 A1* 9/2015 Akiba ..... A61F 2/72 700/275
2015/0297934 A1* 10/2015 Agrawal ..... A63B 21/4025 482/4
2015/0351990 A1* 12/2015 Ewing ..... A61H 1/024 601/5

OTHER PUBLICATIONS http://www.getmotion.com/products-and-services/knees-and-ankles.
https://www.youtube.com/watch?v=OLvJwe5GAfg.
https://www.youtube.com/watch?v=KxyL35LVNZw.
https://www.premera.com/medicalpolicies/CMI_170374.htm.
http://www. medcomgroup.com/medcom-shoulder-cpm-2-week-rental-3-4-week-options-available/?gclid=Cj0KEQjwz6KtBRDwgq-LsKjM k9kBEiQAuaxWUoDxIHSLEEzljGr33vo1-CqoR9YIS3OW19WVGUYI3aMaAhvO8P8HAQ.
www.rehabmart.com/product/centura-bed-wheelchair-shoulder-cpm-marchine-39996.html.

* cited by examiner

Smart Tech–Tablet Interface

*Login Screen*

Uses Patient identification and Patient selected PIN for access.

Patient ID ties to OneDirect backend database and is remembered by Tablet.

Unique Patient ID and First name are only patient identifiable information on tablet.

PIN is required for each session.

Confidential–Please do not distribute

Smart Tech–Tablet Interface

*History Screen*

Shows Calendar log of prior sessions with number of daily sessions shown by day.

Patient touches blinking "Start" button to begin exercise.

Patient can review "Progress" graphs, a "Library" of videos and pdf's, and exchanges messages with their "Provider."

Confidential–Please do not distribute

Smart Tech–Tablet Interface

*Initial Pain capture Dialog*

System provides for the capture of patient Pain scores before, during, and after exercise sessions.

Adjustments can be made at any time to support patient comfort.

Allow the patient to "Direct" the exercise or be "Guided."

Confidential–Please do not distribute

Smart Tech–Tablet Interface

*Self–Directed Mode Screen*

Allow patient to move at three different speeds, or speeds prescribed by physician.

Includes digital goniometer of patient's limb location and current (green) and goal (yellow) zones.

Angle is shown in two (2) locations.

Pain can be reported at any point.

Confidential–Please do not distribute

Smart Tech–Tablet Interface

*Guided Mode Screen*

Patient simply touches green blinking arrow to start exercise.

Includes digital goniometer of patient's limb location and current (green) and goal (yellow) zones.

Angle is shown in two (2) locations.

Pain can be reported at any point.

Confidential–Please do not distribute

Smart Tech–Tablet Interface

*Session Summary Screen*

Congratulates patient to reinforce therapy.

Allows for post–exercise pain recording.

Presents log of exercise.

Session data is uploaded to OneDirect servers for review by provider, clinician, or therapist.

Confidential–Please do not distribute

Therapist 3

- Patients
- Profile
- Appointments
- Transaction Logs

Therapist Patients

Home > Therapist

Show 10 entries

Search:

| Name | Doctor | Date of Surgery | Joint | Rx Start | Rx End | Last Use | Max Pain | % Usage | Progress | Action |
|---|---|---|---|---|---|---|---|---|---|---|
| DP Samantarai | Dr Huma HUMANA | Oct-09 2017 | Knee | Oct-12 2017 | Jul-31 2018 | Mar-14 2018 | 10 | 48% | Flexion 182%<br>Extension 42% | Exercises<br>Sessions Rx<br>Edit Delete<br>Appointments |
| Jamie Lewis | Dr Huma HUMANA | Sep-24 2017 | Shoulder | Feb-27 2018 | Mar-31 2018 | Mar-01 2018 | 8 | 135% | Flexion 182%<br>Extension 42%<br>Abduction 184% | Exercises<br>Sessions Rx<br>Edit Delete<br>Appointments |
| pat5 | Dr Kathir Kaiser | Jan-20 2018 | Ankle | Jan-22 2018 | Feb-24 2018 | – | – | – | Flexion 0%<br>Extension 0% | Exercises<br>Sessions Rx<br>Edit Delete<br>Appointments |
| ram | Dr Kathir Kaiser | Jan-23 2018 | Ankle | Jan-25 2018 | Feb-27 2018 | – | – | – | Flexion 0%<br>Extension 0% | Exercises<br>Sessions Rx<br>Edit Delete<br>Appointments |

FIG. 10

Humana Patient-1

Treatment Calendar

< > today

August 2017

| Sun | Mon | Tue | Wed | Thu | Fri | Sat |
|---|---|---|---|---|---|---|
| 30 0 | 31 0 | 1 3 | 2 2 | 3 3 | 4 4 | 5 4 |
| 6 4 | 7 3 | 8 4 | 9 3 | 10 1 | 11 2 | 12 0 |
| 13 0 | 14 0 | 15 0 | 16 0 | 17 0 | 18 0 | 19 0 |
| 20 0 | 21 0 | 22 0 | 23 0 | 24 0 | 25 0 | 26 0 |
| 27 0 | 28 0 | 29 0 | 30 0 | 31 0 | 1 0 | 2 0 |

FIG. 12A

Current Sessions

Show 10 ▼ entries

| Name | Date | Duration(hh:mm:ss) | Reps | Current ROM | Pain |
|---|---|---|---|---|---|
| Ankle Wk1 | 11-Aug-2017 | 01:43:00 | 3 | -24 to 15 | 2 |
| Ankle Wk1 | 09-Aug-2017 | 01:15:00 | 3 | -43 to 31 | 1 |
| Ankle Wk1 | 08-Aug-2017 | 00:37:00 | 0 | -45 to 32 | 1 |
| Ankle Wk1 | 08-Aug-2017 | 00:49:00 | 1 | -39 to 20 | 1 |
| Ankle Wk1 | 07-Aug-2017 | 12:06:00 | 3 | -36 to 23 | 3 |
| Ankle Wk1 | 07-Aug-2017 | 10:16:00 | 4 | -51 to 21 | 1 |
| Ankle Wk1 | 06-Aug-2017 | 00:59:00 | 1 | -41 to 34 | 1 |
| Ankle Wk1 | 06-Aug-2017 | 00:41:00 | 3 | -36 to 27 | 1 |
| Ankle Wk1 | 05-Aug-2017 | 00:46:00 | 0 | -24 to 32 | 0 |
| Ankle Wk1 | 05-Aug-2017 | 02:15:00 | 7 | -32 to 34 | 0 |

Showing 1 to 10 of 33 entries

First | Previous | Next | Last

FIG. 12B

Jamie Lewis Sessions

Home > Session

⊙ Straight Arm Forward Flexion ○ Abduction ○ External Rotation Add

Show 10 entries Search

| Protocol Name | Date | Pain Count | Duration (hh:mm:ss) | Reps | Flexion Archieved | Flexion Goal | Horizontal Position | Abductor Position | Type | |
|---|---|---|---|---|---|---|---|---|---|---|
| Month1–Forward Flexion | Oct–30–2017 | | 4 minutes, 3 seconds | 10 of 10 | 75 | 90 | – | – | G | Delete |
| Month1–Forward Flexion | Nov–13–2017 | | 11 minutes, 21 seconds | 10 of 10 | 67 | 90 | – | – | G | Delete |
| Month1–Forward Flexion | Nov–13–2017 | | 7 minutes, 1 seconds | 10 of 10 | 75 | 90 | – | – | G | Delete |
| Month1–Forward Flexion | Nov–17–2017 | 2 | 6 minutes, 49 seconds | 10 of 10 | 75 | 90 | – | – | G | Delete |
| Month1–Forward Flexion | Nov–17–2017 | 1 | 6 minutes, 19 seconds | 10 of 10 | 75 | 90 | – | – | G | Delete |
| Month1–Forward Flexion | Nov–18–2017 | 2 | 3 hours, 38 minutes, 16 seconds | 10 of 10 | 0 | 90 | – | – | G | Delete |
| Month1–Forward Flexion | Nov–20–2017 | | 10 minutes, 8 seconds | 10 of 10 | 61 | 90 | – | – | G | Delete |
| Month1–Forward Flexion | Nov–20–2017 | | 9 minutes, 48 seconds | 10 of 10 | 75 | 90 | – | – | G | Delete |

FIG. 13

Edit Emma Walker's Flexion–Extension Knee Protocol

Home > Session

Protocol Type: Flexion–Extension

Protocol Name: After Week2–Flexion–Extension

Start Date*: Sep–26–2017

End Date*: Jan–20–2018

Flexion

Current End Range
Angles should be between 90 to 132
95

End Range Goal
Angles should be between 90 to 132
115

Hold time (seconds) at End Range Goal
10

Extension

Current End Range
Angles should be between 90 to −10
70

End Range Goal
Angles should be between 90 to −10
0

Hold time (seconds) at End Range Goal
10

Rest Time (seconds)
0 at ⊙Neutral ○Current

Reps
10 at ⊙End Goal Range ○Progressing to End Range Goal

Speed
0

Estimated Duration (minutes)
23

FIG. 14

Patient Review ON: 01:41 Tara Pitts (AML)

- Patients
- Profile
- Appointments
- Patient Messages
- Patient Reviews

Mark Mark

Home > Exercises

Summary | Details | Rx | Exercises | Sessions | Patient Reviews | Appointments | Messages Flexion–Ex Comment The Exercise hold times need to be increased.

Save Cancel

Show 10

Add

Search:

| Exercise Name | Exercise Type | Flexion Current | Flexion Goal | Extension Current | Extension Goal | Reset Time | Start Date | End Date | Duration | Action |
|---|---|---|---|---|---|---|---|---|---|---|
| 1Extension | Extension | | | 28 | 13 | 30 sec(s) | Jun–11 –2018 | | 75 min(s) | Edit |
| 2Flexion | Flexion | 47 | 62 | | | 30 sec(s) | Jun–11 –2018 | Sep–30 –2018 | 13 min(s) | Edit |
| 3Flex–Ext | Flexion–Extension | 47 | 62 | 28 | 13 | 30 sec(s) | Jun–11 –2018 | Sep–30 –2018 | 14 min(s) | Edit |
| Initial Extension | Extension | | | 28 | 13 | 30 sec(s) | Jun–11 –2018 | Sep–30 –2018 | 10 min(s) | Edit |
| Initial Flexion | Flexion | 47 | 62 | | | 30 sec(s) | Jun–11 –2018 | Sep–30 –2018 | 10 min(s) | Edit |
| Initial Flexion–Extension | Flexion–Extension | 47 | 62 | 28 | 13 | 30 sec(s) | Jun–11 –2018 | Sep–30 –2018 | 33 min(s) | Edit |

Showing 1 to 6 of 6 entries

Previous 1 Next

FIG. 15

Patient Review ON: 01:41 AML Patient Admin

- Patients
- Profile
- Patient Reviews

Mark Mark Review

Home > View Review

TREX Rehab
Patient Name: Mark Mark
Primary Physician: Dr Huma HUMANA
Primary Therapist: Tara Pitts (AML)
Primary Administrator: AML Patient Admin
Date of birth: 01-01-1990

Evaluation Date: 10-03-2018
Evaluation: AML Patient Admin

Physical therapy Evaluation

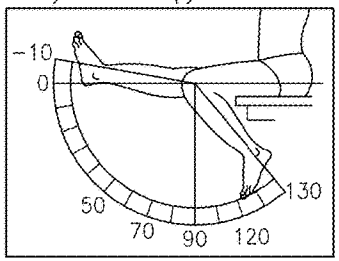

Subjective
Left Knee Surgery on 06-11-2018

Objective
Range of Motion

| Exercise | Flexion Goal | Flexion Achieved | Extension Goal | Extension Achieved | Pain Level |
|---|---|---|---|---|---|
| Flexion Extension | 120 | 62 | -10 | 37 | 6 |

Active Exercises

| Exercise | Type | Flexion Current | Flexion Goal | Extension Current | Extension Goal | Start Date | End Date |
|---|---|---|---|---|---|---|---|
| 3 Flex-Ext | Flexion Extension | 47 | 62 | 28 | 13 | 06-11-2018 | 09-30-2018 |
| 2 Flexion | Flexion Extension | 47 | 62 | | | 06-11-2018 | 09-30-2018 |
| Initial Flexion-Extension | Flexion Extension | 47 | 62 | 28 | 13 | 06-11-2018 | 09-30-2018 |
| Initial Flexion | Flexion Extension | 47 | 62 | | | 06-11-2018 | 09-30-2018 |
| Initial Extension | Flexion Extension | 47 | 62 | 28 | 13 | 06-11-2018 | 09-30-2018 |
| Initial Extension | Flexion Extension | | | 28 | 13 | 06-11-2018 | |

Assessment
Plan

Email PDF Print

FIG. 16

PROGRAMMABLE RANGE OF MOTION SYSTEM

RELATED APPLICATIONS

This application is a continuation in part of co-pending U.S. patent application Ser. No. 16/121,783 filed on Sep. 5, 2018 entitled, "Shoulder End Range of Motion Improving Device" which is a division of U.S. patent application Ser. No. 14/837,280 filed on Aug. 27, 2015 entitled "Shoulder End Range of Motion Improving Device" which is a continuation in part of U.S. Pat. No. 9,669,249 issued on Jun. 6, 2017 entitled "Range of Motion Improvement Device".

FIELD OF THE INVENTION

The present invention relates to a computer programmable range of motion device and system for rehabilitation of patients' limbs that has a range of motion device for the arm or a range of motion device for the leg that can be power driven to emulate force loads and motions that would be applied by a therapist during physical therapy.

BACKGROUND OF THE INVENTION

A patient that has undergone a surgical procedure or otherwise has a limited range of motion of an extremity can experience a "frozen shoulder" or "stiff knee" as a result of a buildup of scar tissue. These conditions greatly limit the patient's range of motion of the arm or leg. Physical therapy is typically prescribed to work the knee, hip or shoulder or elbow to break down the scar tissue and regain proper mobility of the joints.

Ideally, the physical therapy would be provided once or multiple times daily over a period of weeks to restore the patient's motion. This creates a hardship for the rehab patients in time and money. To overcome this, many exercises have been devised to be done at home such as the elastic belts and other stretching devices. Unfortunately, unmonitored and unsupervised exercises expose the patients to additional injury, particularly after a surgical procedure.

Accordingly, there is a need to provide a system and equipment that can provide range of motion rehabilitation exercises in a controlled and safe way at a patient's home.

Furthermore, the objective is to provide the patient with a prescription for rehabilitation exercises that can be loaded remotely to a computer control system to provide a desired schedule and selected range of motion limits and forces chosen by the physician or therapist that can be securely accessed and monitored by the patient's physician or physical therapist wherein the computer is programmed to control the equipment and provide an accessible database documenting the exercise progress of the patient. The present invention as described hereinafter provides a safe and manageable home-based rehabilitation system.

Definitions

CPM—Continuous Passive Motion (CPM) is a postoperative rehabilitation therapy designed to aid in patient recovery after joint surgery, soft tissue surgical procedure or trauma. Passive range of motion moves the joint gradually and slowly without the use of the patient's muscles. The device is applied post-operatively and can be used in both inpatient and outpatient therapy regimens. The physician will prescribe usage instructions, including the speed of the machine, the duration of usage, amount of motion and the rate of motion increase.

Extension, a straightening or backward movement of the spine or limbs.

Flexion, a bending or forward movement of the spine or limbs.

Physical therapy is defined as therapy for the preservation, enhancement, or restoration of movement and physical function impaired or threatened by disease, injury, or disability that utilizes therapeutic exercise, physical modalities (such as massage and electrotherapy), assistive devices, and patient education and training—called also physiotherapy.

PNF stretching, or proprioceptive neuromuscular facilitation stretching, is a set of stretching techniques commonly used in clinical environments to enhance both active and passive range of motion in order to improve motor performance and aid rehabilitation. PNF is considered an optimal stretching method when the aim is to increase range of motion, especially as regards short-term changes.

SUMMARY OF THE INVENTION

A programmable range of motion system has a frame, a range of motion device, a controller, a computer and sensors. The frame has a seat to support a rehab patient. The range of motion device is attached to the frame. The actuator, servo or alternate mechanism selectively rotates the range of motion device through a range of motion for a rehab patient's limb. The controller controls the actuator, servo or alternate mechanism. The computer is connected electronically to the controller. The computer has a software, program or application including a plurality of programmable range of motion movements for exercising the limb. The sensor detects movements of the actuator, servo or alternate mechanism and records data back to the computer. The term actuator as used hereafter includes servo or alternate articulating mechanism.

Preferably, the computer can be a phone or tablet or small portable device that has a touch screen and has internet connectivity. The computer can be wired or wirelessly connected to the controller.

A physician can prescribe rehabilitation exercises in the form of a prescription for the rehab patient remotely via a remote server and securely transmit the prescription to the computer. Each patient is provided a secure ID for accessing the computer software, program or application.

The patient has operating control for the range of motion device through the computer. The computer software, program or application provides a plurality of screen displays. One screen display shows the range of motion in real time in an anthropometric representation or avatar of the patient. One screen display provides patient pain levels indications inputtable by the patient. One screen display shows the exercise completion performance Preferably, the software, program or application provides a neutral or at rest position for the range of motion device for each exercise. The software, program or application also provides an entry ingress or egress position to facilitate attaching or detaching the range of motion device to the limb. For safety, the software, program or application has a built-in range of motion safety override to prevent limb damage. The computer provides remote chat or teleconferencing between the patient and the physician or rehab technician.

In a first embodiment, the programmable end range of motion system for a leg has a frame having a seat adjustably mounted on the frame configured to support a rehab patient, a plurality of legs elevating the seat above a floor and one or more frame attachment locations for receiving one or more range of motion improving devices; a leg end range of motion improving device for attachment to a patient's leg, the leg end range of motion improving device attached to the frame, a leg linkage connected to said frame, the leg linkage including a support affixed to said frame at one of said attachment locations; a leg linkage, the leg linkage including: a first link member; a second link member supported on the first link member, the second link member configured for being secured to a lower leg of the patient and being rotatable about a second link member axis for rotating the lower leg of the patient about a knee axis of the patient through a lower leg range of motion, the second link member axis being displaceable into a selectable fixed position aligned with the knee axis and maintaining the fixed position during rotation of the second link member; the first link member being independently rotatable about a first link member axis without causing the second link member to rotate about the second link member axis, and the second link member being independently rotatable about the second link member axis without causing the first link member to rotate about the first link member axis; a leg actuator for rotating the second link member about the second link axis; a controller controlling the leg actuator for selectively rotating the second link member about the second link axis through the lower leg range of motion or the arm actuator; a computer connected electronically to the controller, the computer having a software, program or application including a plurality of programmable range of motion movements for exercising the limb; and a sensor or sensors to detect movements of the patient, device or actuator and record data back to the computer.

In a second embodiment, the programmable end range of motion system has a frame having a seat adjustably mounted on the frame configured to support a rehab patient, a plurality of legs elevating the seat above a floor and one or more frame attachment locations for receiving one or more range of motion improving devices; an arm end range of motion improving device for attachment to a patient's arm, the arm end range of motion improving device attached to the seat with a backrest, an arm linkage connected to said backrest, the arm linkage including a support affixed to said backrest at one of said attachment locations and disposed above said backrest; a first link member affixed to said support; a second link member supported on the first link member, the second link member configured for being secured to an arm of a patient and being rotatable about a second link axis for rotating the arm of the patient about a shoulder joint of the patient through an arm range of motion, the second link axis being displaceable into a selectable fixed position and maintaining the fixed position during rotation of the second link member; an arm actuator for rotating the second link member about the second link axis through the arm range of motion; a controller controlling the actuator for selectively rotating the second link member about the second link axis through the arm range of motion; a computer connected electronically to the controller, the computer having a software, program or application including a plurality of programmable range of motion movements for exercising the limb; and a sensor or sensors to detect movements of the patient, device or actuator and record data back to the computer.

BRIEF DESCRIPTION OF THE DRAWINGS

The invention will be described by way of example and with reference to the accompanying drawings in which:

FIG. 10 is a web-based therapist screen showing patients and Rx (prescription) status.

FIG. 12A is a web-based treatment calendar.

FIG. 12B is a web-based treatment session schedule.

FIG. 13 is a web-based screen showing a patient straight arm forward flexion session.

FIG. 14 is a web-based patient's flexion knee exercise creation and edit screen.

FIG. 15 is a web-based patient prescription creation and edit screen.

FIG. 16 is a system generated Subjective, Objective, Assessment, Plan (SOAP) report or note.

DETAILED DESCRIPTION OF THE INVENTION

The present invention is a unique refinement of the "Shoulder End Range of Motion Improving Device" of U.S. patent application Ser. No. 14/837,280 filed on Aug. 27, 2015 and U.S. Pat. No. 9,669,249 issued on Jun. 6, 2017 entitled "Range of Motion Improvement Device" both of which are being incorporated herein by reference in their entirety.

Each of these two devices have a range of motion device attached to a frame. One arm range of motion device is for improving an arms range of motion at a shoulder joint or elbow utilizing a prescribed programmed arm exercise protocol. The other leg range of motion device is for improving a leg range of motion at a hip or knee joint utilizing a prescribed programmed leg exercise program.

Figure 1:
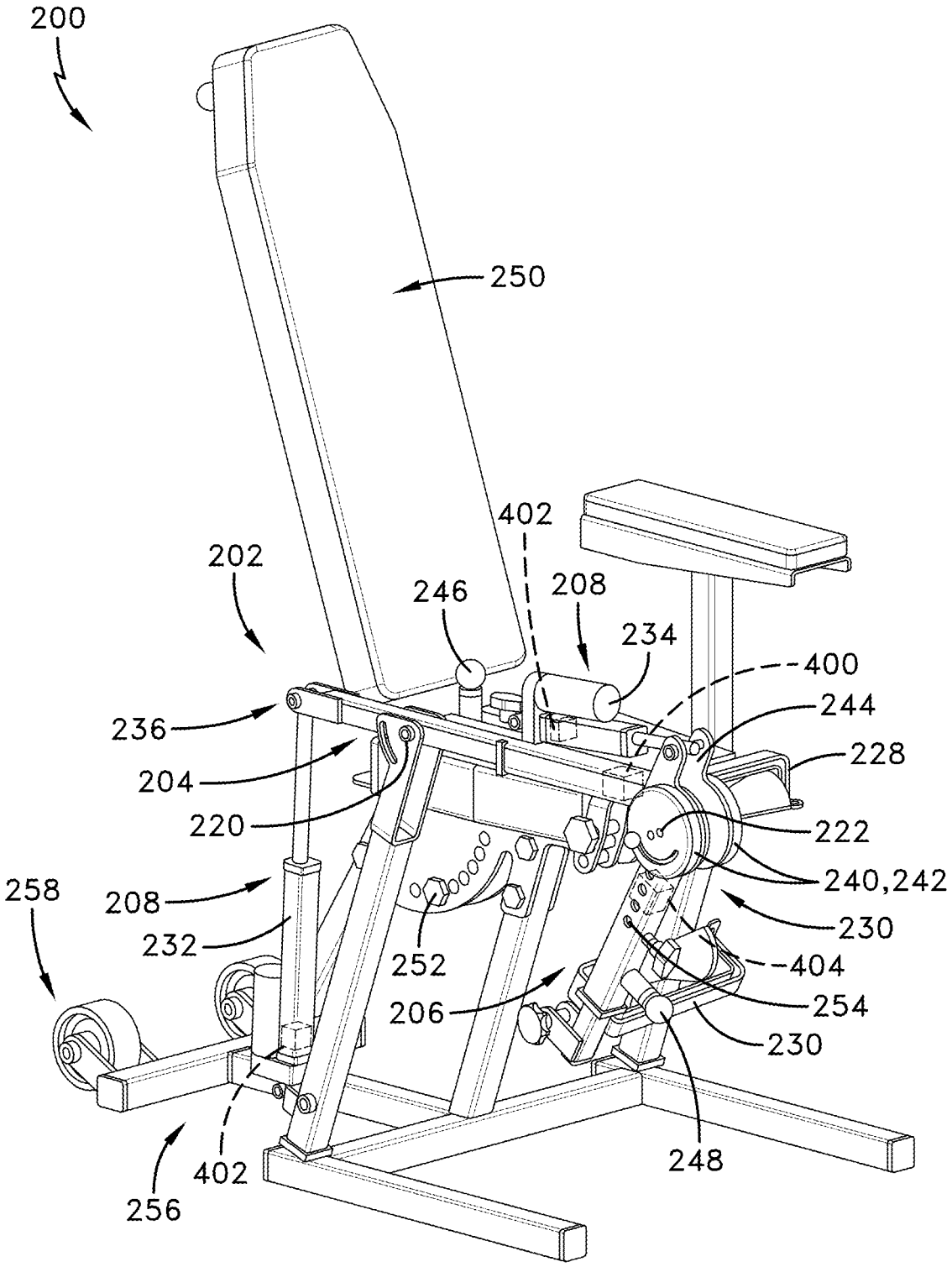
FIG. 1 is a perspective view of a first embodiment of the End Range of Motion leg device shown attached to a frame made in accordance with the present invention.
Figure 2:
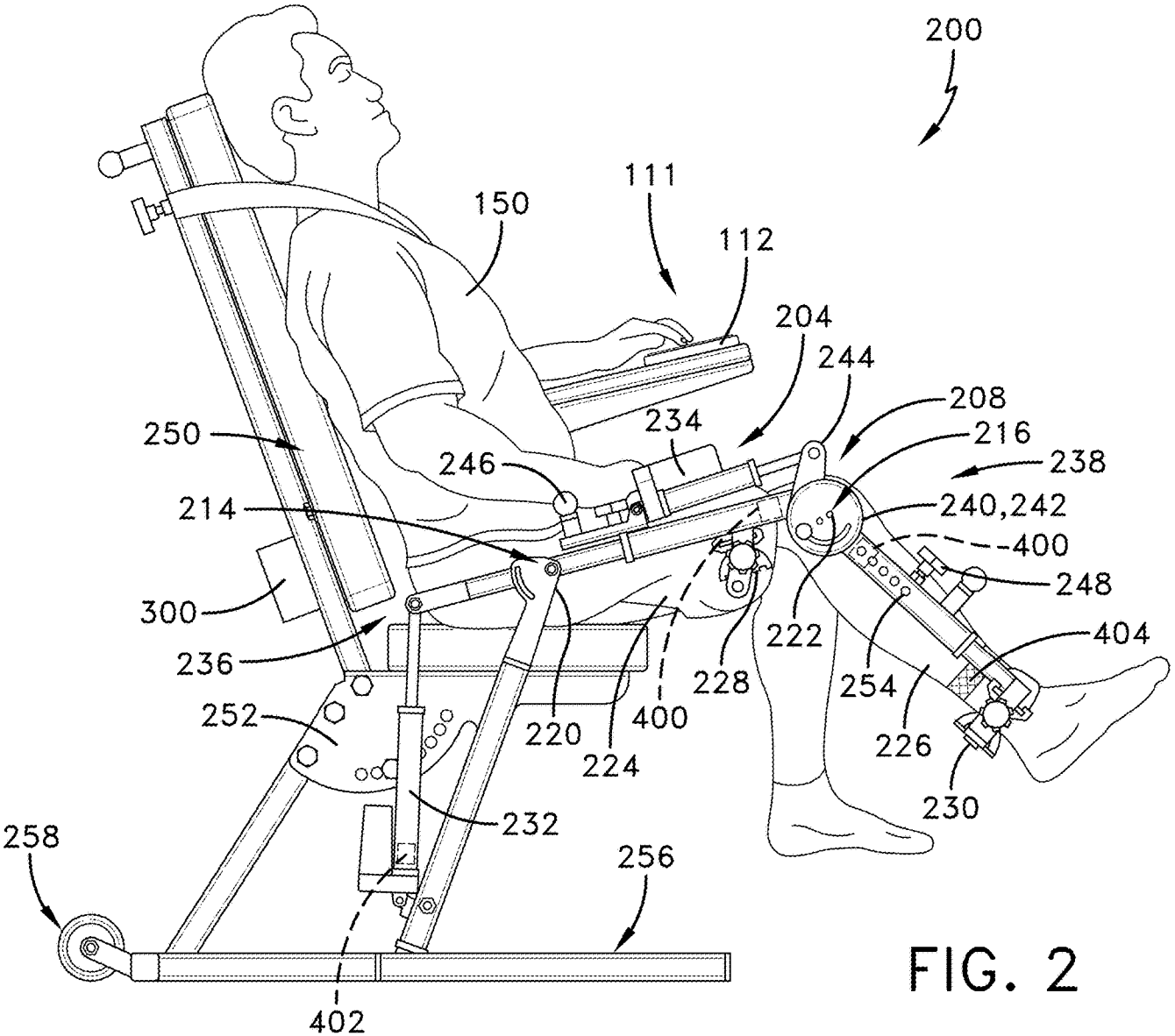
FIG. 2 is a side view of a rehabilitation patient seated and using the End Range of Motion leg device of FIG. 1.

To best understand the present invention, one needs to first appreciate the unique equipment the inventors developed. The device is referred to as a Total Range Exerciser referred to by the acronym T-REX. These devices as shown in FIGS. 1 and 2 for the leg and FIGS. 15-21 for the arm provide unique opportunities to improve at home rehabilitation of arm and leg injuries or trauma, particular those after joint surgery.

T-REX units are power driven devices that provide patients with "High Intensity Stretching" sessions designed to emulate the exact force loads and motions applied by a therapist during physical therapy sessions. Many medical studies documents that the best chance of preventing a "frozen shoulder" or "stiff knee" following surgery is to have patients engage in "high intensity stretching" sessions that mimic the high load/force applied by physical therapy daily for one hour per day. Daily use will reduce actual physical therapy sessions. The T-REX Knee and Shoulder units are designed with "mechanical joints" that mirror human joints. They are modular, and when a patient is fitted, the T-REX "mechanical joints" are properly aligned with patient joints to insure all therapy is conducted in a comfortable and anatomically correct manner.

The T-REX Knee is a device that allows for functional Rehabilitation of the knee throughout all "planes of motion" movement by allowing more than one joint to move at a time. T-REX allows the hip motor and knee motor to function simultaneously and independent of one another allowing for multi-dimension exercise motion. Thus, T-REX rehab motions are uniquely engineered to improve patients' ability to walk stairs, ride a bike, get in and out of cars, get into and out of bed, bend down, etc. all functional motions that require the knee to be used in various planes.

This T-REX Knee device allows a patient to receive both extension and flexion therapy from the same device while allowing for eccentric and concentric strength training as well as PNF (proprioceptive neuromuscular facilitation) stretching for the hamstring, quad, and surrounding tissue.

The T-REX Shoulder device is the only home based Rehabilitative Shoulder System with a tri-actuator design that allows patients to engage in all shoulder ROM (range of motion) therapies from one machine with no manual adjustments required. The T-REX Shoulder device allows for complete forward flexion and/or scapular extension. The T-REX Shoulder device allows for internal and external rotation to work along all planes of motion when coupled with abduction-adduction motions in lateral, scapular or forward positioned. The T-REX Shoulder device allows for retraction motion with internal and external rotation, this is critical to regain full range of motion. The T-REX Shoulder device allows for straight-arm cross-body horizontal stretching for posterior capsular release of contracture in shoulder.

CPM (continuous passive motion) vs T-REX: Compliance difference: Patients need to use CPM devices 6 to 8 hours per day. The T-REX can be used one hour per day. Knee CPM devices do not allow for true knee extension which is critical to fully regain Range of Motion. The T-REX Knee device allows for true knee extension. Shoulder CPM devices lack ability to provide 175-degree straight arm extension. The T-REX Shoulder device allows for this. T-REX, in the High Intensity Stretching mode, functions much differently than a Continuous Passive Motion (CPM) device. A CPM is a passive (zero load/intensity) motion device designed to move the joint or knee following surgery to promote better circulation and reduce swelling. It is not designed to breakdown scar tissue. The T-REX device is an "active-resistance" unit designed to break down scar tissue to prevent loss for Range of Motion. T-REX is not just a "motion device", instead it's designed to restore "patient's motion" thru active-resistance sessions or alternatively can be set to machine driven passive or low load mode depending on the treatment.

A T-REX can be ordered following ALL Knee and Shoulder operations where post-operative ROM and muscle weakness will need to be completely restored. See some examples below: Knee: Post TKA (Total Knee Arthroplasty), Post partial knee replacement Post ACL (anterior cruciate ligament)/PCL (posterior cruciate ligament), Post patella repair, Complex meniscus tears Pre-Manipulation, Post Manipulation Joint, stiffness. Shoulder: Post Shoulder Scope, Post Total Shoulder, Post SLAP (superior labral tear from anterior to posterior) repair, Post Labrum repair, Post Rotator Cuff Repair, Post biceps tendon repair Pre-Shoulder Manipulation, Post Shoulder Manipulation, Frozen Shoulders/Adhesive capsulitis, Shoulder impingement syndrome.

Since T-REX is versatile, personalized, and mimics natural anatomical movement for both shoulder and knee, it can either do light movement and stretching, on a new surgically repaired joint, or apply a High Intensity stretching force, like what a patient experiences in PT sessions. Both intensities will prevent, permanently elongate, and/or breakdown scar tissue.

With reference to FIGS. 1-2, the programmable range of motion system 200 specifically with a leg range of motion device attached to the frame is shown.

FIGS. 3-14 show various display screens provided by the Smart Rehab Technology computer software, program or application for the patient to use with the T-Rex exerciser.

Figure 3:
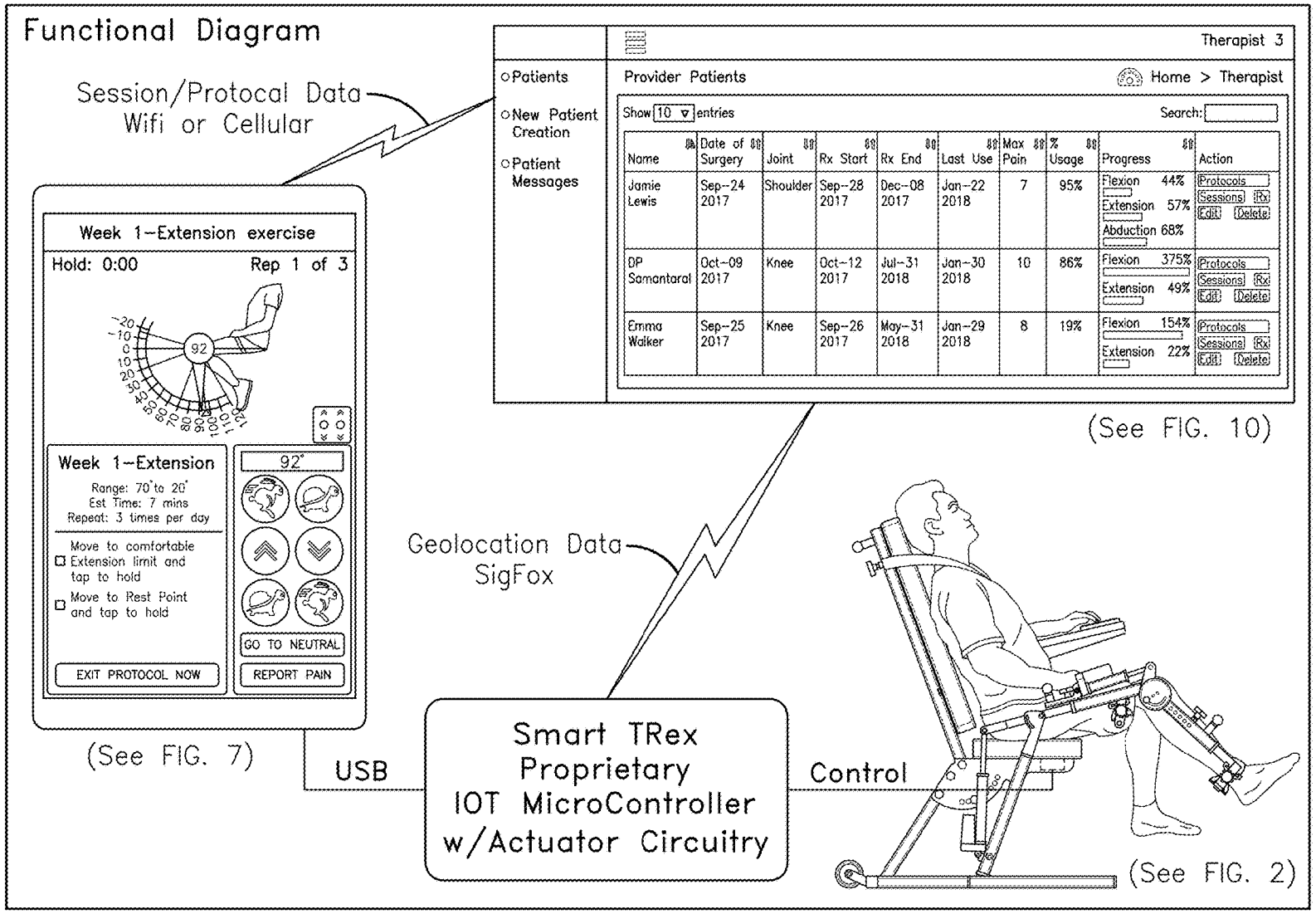
FIG. 3 is a functional diagram of a Smart Rehab Technology program showing a computer in the form of a tablet, the first embodiment from FIG. 2, a display screen showing a Wi-Fi or cellular connection to the computer and a balloon identifying the electronic hardware used to control the first embodiment device.

FIG. 3 shows a functional diagram for the Smart Rehab Technology software detailing the Smart T-REX proprietary Internet of Things (IOT) microcontroller with actuator circuitry and its functions. One screen is displayed on an Android, Apple, comparable or proprietary tablet showing Week 1 leg extension exercise with instructions and speed input options, better shown in FIG. 7. The control function is shown with patient using the T-Rex device, as shown in FIG. 2. Another display screen is shown for the session/protocol data for the patient session, as better shown in FIG. 10.

Figure 4:
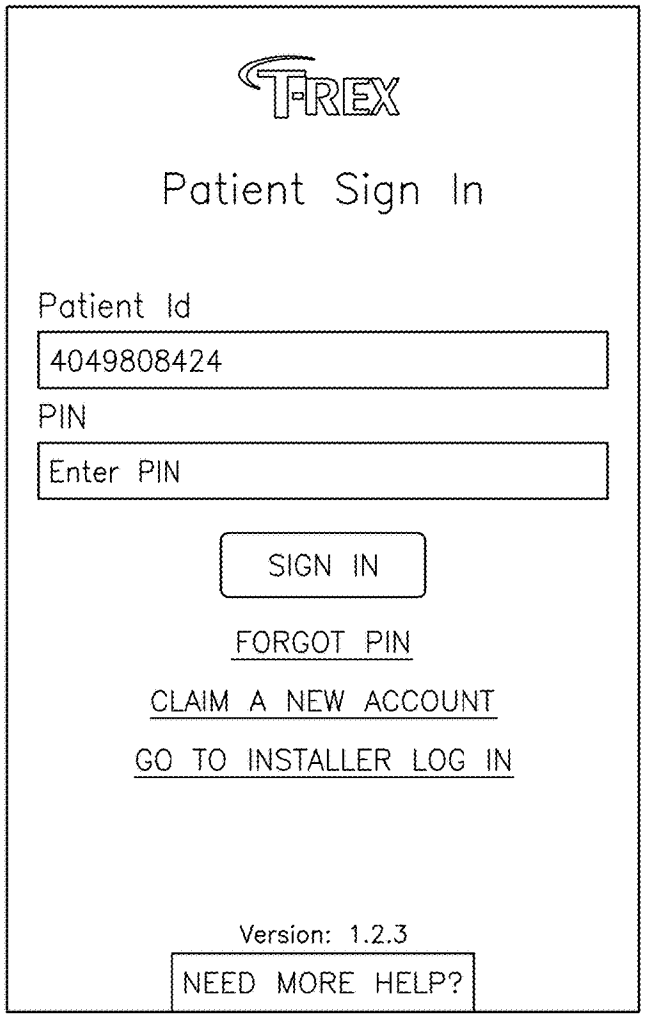
FIG. 4 illustrates a rehab patient's login screen.

FIG. 4 is a detailed example of the patient sign in or login screen for the Smart Rehab Technology software using a patient identification and PIN for access. A unique patient ID and first name are the only patient identifiable information on the tablet. The patient ID ties to OneDirect backend database and is remembered by the tablet. The PIN is required for each session.

Figure 5:
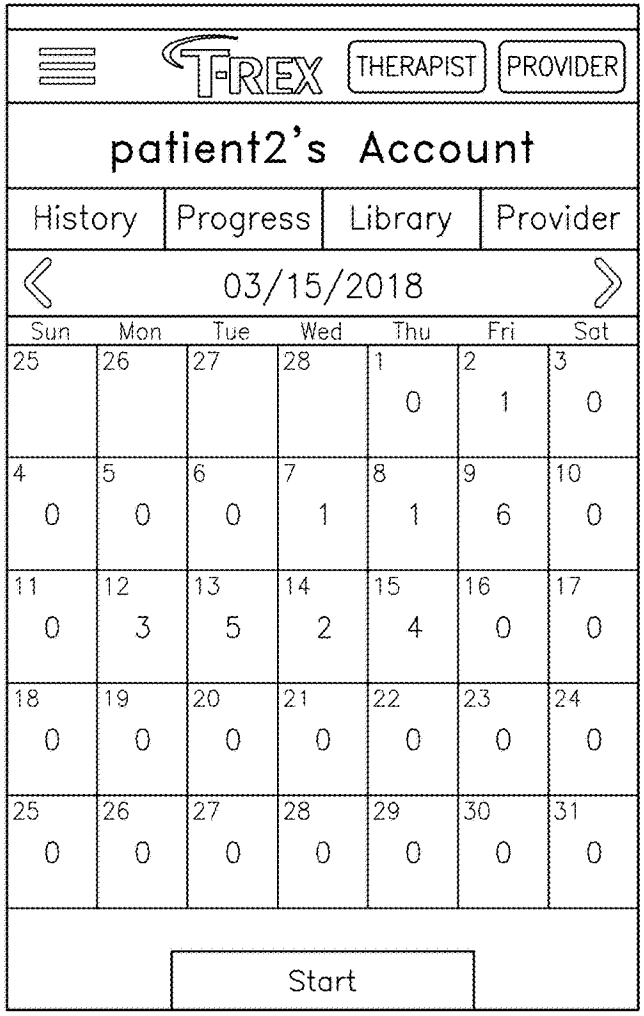
FIG. 5 illustrates the rehab patient's history screen.

FIG. 5 shows a calendar or history screen with a calendar log of prior sessions with number of daily sessions shown by day. The patient touches the blinking "start" button to begin exercise. Patients can review "progress" data and graphs, a "library" of videos and pdf's, connect to web-based personalized exercises, schedule and conduct video-conferences and exchange messages with their "provider," therapist, or administrator.

Figure 6:
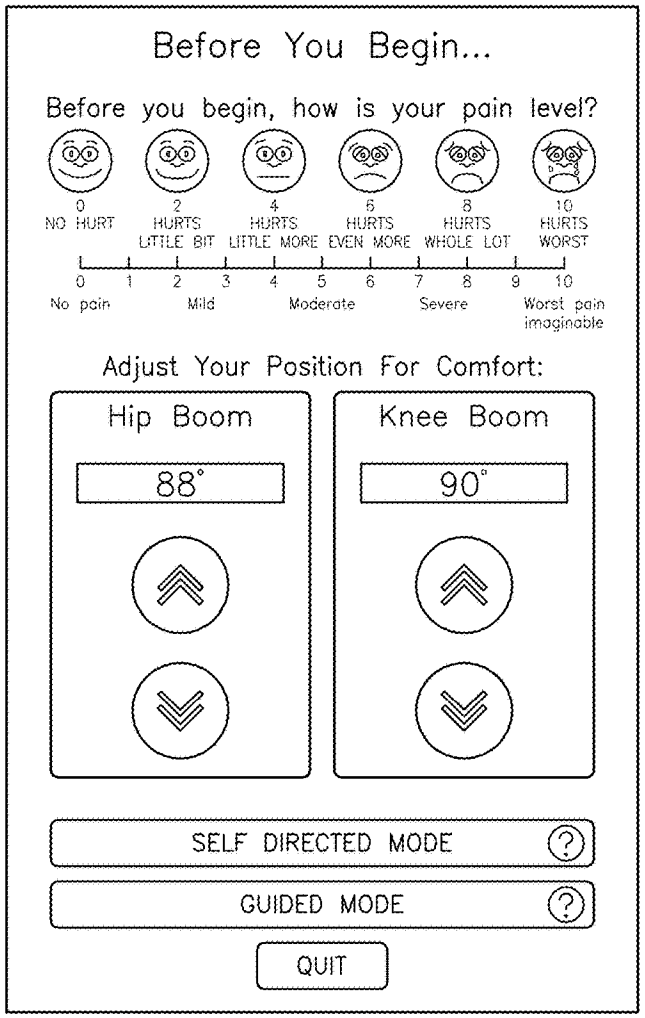
FIG. 6 illustrates a pain capture screen.

FIG. 6 shows a display for the Initial Pain Capture Dialog screen. The system provides for the capture of patient pain scores before, during and after exercise sessions. The pain scores are chosen from a scale of 0 to 10, 0 being "no pain" and 10 being "worst pain imaginable". Emoticons are provided on the numeric scale to help the patient choose an accurate pain level. Adjustments can be made at any time to support patient comfort. At this screen, the program allows the patient to "direct" the exercise by selecting the self-directed or manual mode or be "guided" by selecting the guided or automated mode.

Figure 7:
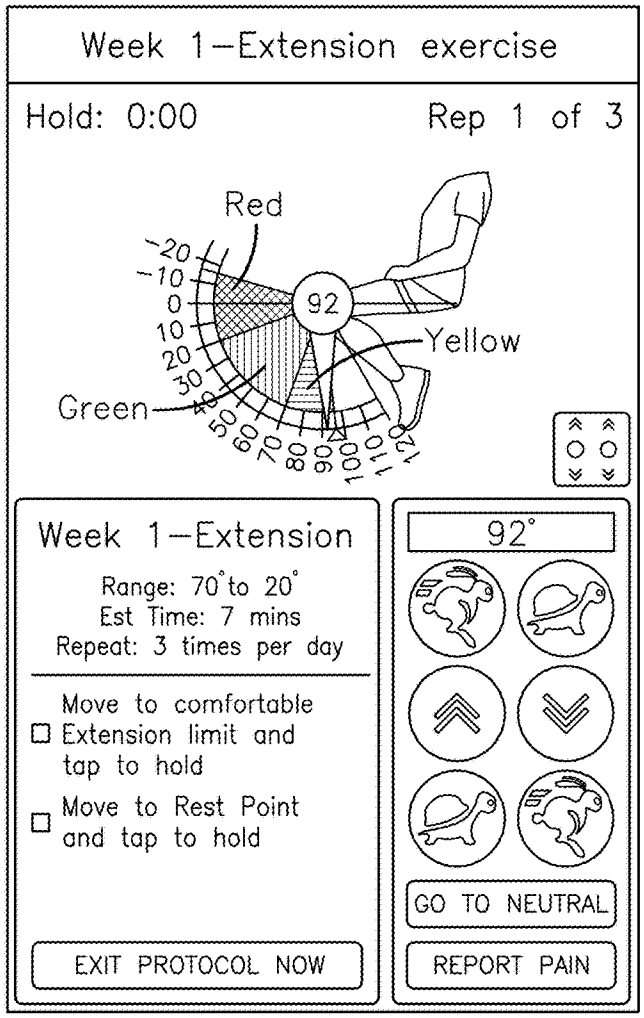
FIG. 7 illustrates a self-directed mode screen.

FIG. 7 illustrates the Self-Directed Mode Screen which allows the patient to choose from 3 options for speed of the exercise or a speed prescribed by their physician or therapist. See FIG. 15 for entry of Speed by Physician. The speed setting is represented by a rabbit, arrows, and a turtle. There is also an option for "go to neutral or rest". Pain can be reported at any time by selecting the "report pain" button. This screen includes a dynamic digital goniometer of the patient's limb location through an anthropometric avatar representing the patient, and the patient's movements. The screen further shows the current zone, which is defined as the patient's current comfortable range of motion, shown in green, and goal zones, which are defined as the patient's current exercise goal, shown in yellow. The current angle of the limb in degrees are shown in one or two locations, one in the goniometer illustration and one above the speed settings. The Goal zones, shown in yellow, are prescribed by the physician or therapist and provide a safe limited range of motion for the patient. As the patient achieves range of motion goals, intelligent algorithms processing on controller 112 automagically expand new safe range of motion goals based on the physicians pre-determined per-exercise limits for subsequent exercises. This means the physician or therapist can be assured the patient's exercise plan or protocol is automatically adjusted without requiring the patient or the physician to meet or take further action.

Pain can be reported at any time by selecting the "report pain" button. This allows for the unique ability to capture not only a pain score but pain in context. The system records the pain score, with date and time of session, the current angle that pain occurred and the point in the exercise, repetition and time. All data is reported back to the server and remotely viewable by the physician or therapist through a web-based connection either after session completion or while patient is exercising. The patient and physician during prescription setup have determined a maximum pain threshold which is downloaded into the controller 112. Should the patient enter a Pain score at or above the agreed upon Pain threshold (See FIG. 15), intelligent algorithms will revise the current exercise and prevent the patient from reaching that angle again during the exercise session. This in fact, reduces the prescribed range of motion and furthers prevents injury. Further, these elevated pain scores are highlighted on the physician view on the web server (See FIG. 10).

Figure 8:
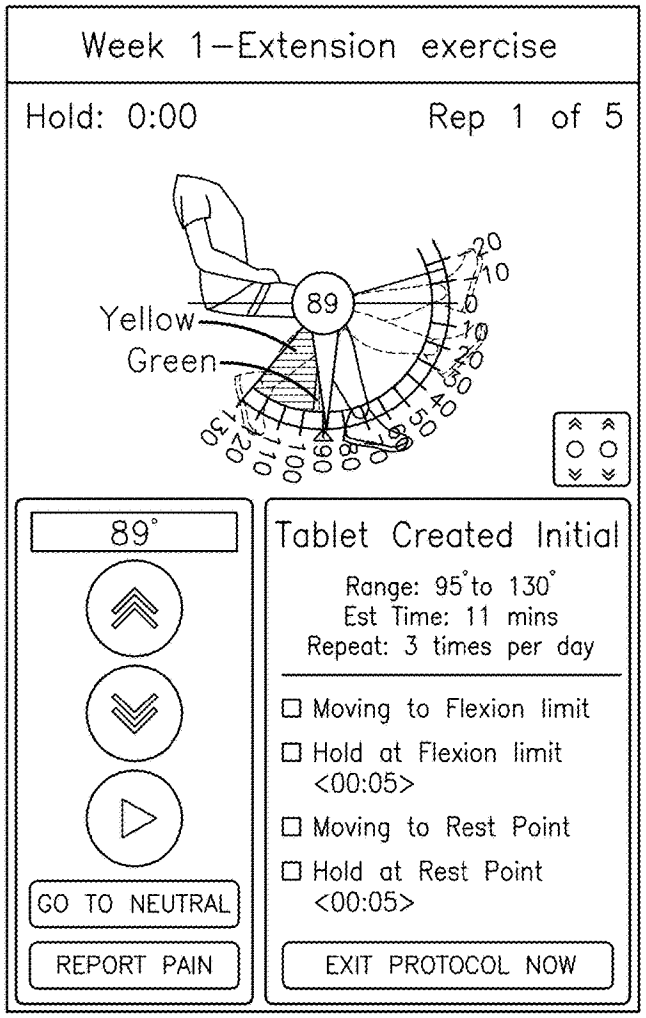
FIG. 8 illustrates a guided mode screen.

FIG. 8 shows the "Guided Mode Screen". On this screen the patient touches the green blinking arrow to start the exercise. This screen also displays the digital goniometer of the patient's limb location, an anthropometric representation or avatar of the patient and current zone, shown in green, and goal zones, shown in yellow. Angles are shown in one or two locations, one in the goniometer illustration and one above the arrow settings. All visual interface and automated functionality in the aforementioned Self-Guided mode is included in the Guided Mode along with the following additional functionality: the physician or therapist can fully prescribe the exercise's valid dates, range of motion, speed, hold times, rest times, repetitions and sequence.

Figure 9:
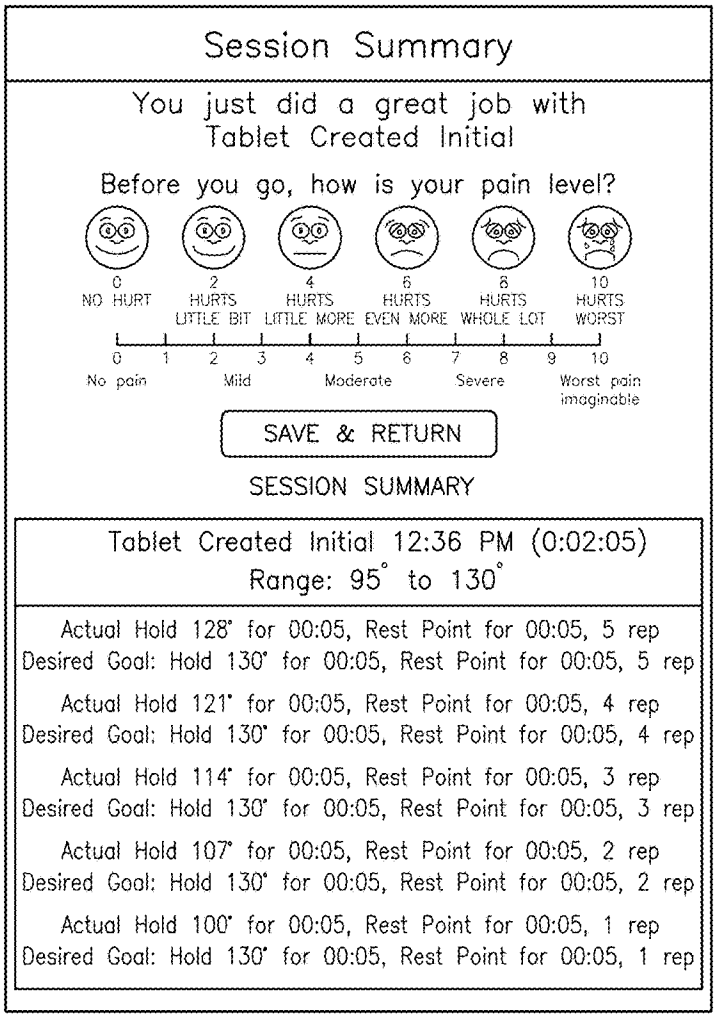
FIG. 9 illustrates a session summary screen.

FIG. 9 shows the "Session Summary Screen" where the patient is congratulated to reinforce therapy. This screen allows for post exercise pain level recording using the same scale as the initial pain level screen. A log of exercises is also provided on this screen. The session data is uploaded to OneDirect servers for review by provider, clinician or therapist by selecting the "save & return" button.

FIG. 10 begins a description of some of the web server screens and is a detailed illustration of the display screen for the session/protocol data for the patient session for each patient of a particular physician or therapist. It allows the clinician to rapidly sort a number of patients by key metadata like RX End Date, Max Pain, % Usage and Relative Progress. Relative Progress is a proprietary algorithm that allows the physician or Therapist to ascertain rapidly whether a patient is making progress. Relative Progress is defined as Current range of motion in degrees divided by Expected Progress range of motion in degrees.

Where Current ROM is the ROM the patient is currently achieving on the T-rex and Expected Progress ROM is defined as: Expected Progress ROM=(((Final ROM−Start ROM)/Prescription Days)×Days Passed). Final ROM is the patient's expected ROM after prescription completion. Start ROM is the patient's ROM at beginning of prescription. Prescription Days is the number of days in the prescription. Days Passed is the number of days since beginning prescription. So, for example, if the patient started with 20 degrees of motion after surgery (Start ROM), the goal after 30 day prescription was 120 (Final ROM), 14 days had passed, and their Current ROM was 40 degrees then the f(x) would be as follows: Relative Progress=40/(((120−20)/30)×14)=86%.

Figure 11A:
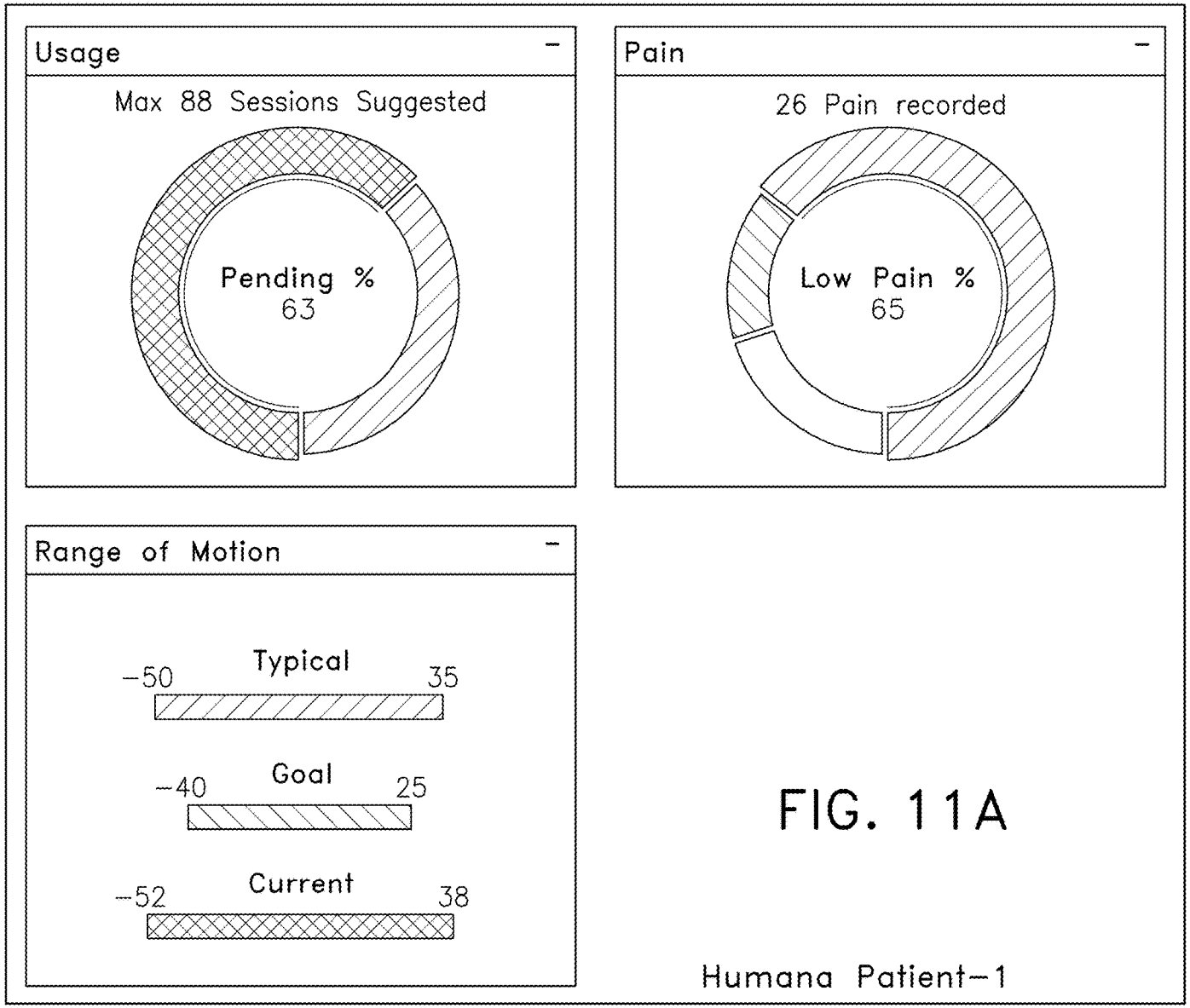
FIG. 11A is a web-based screen showing an exemplary patient 1 status.
Figure 11B:
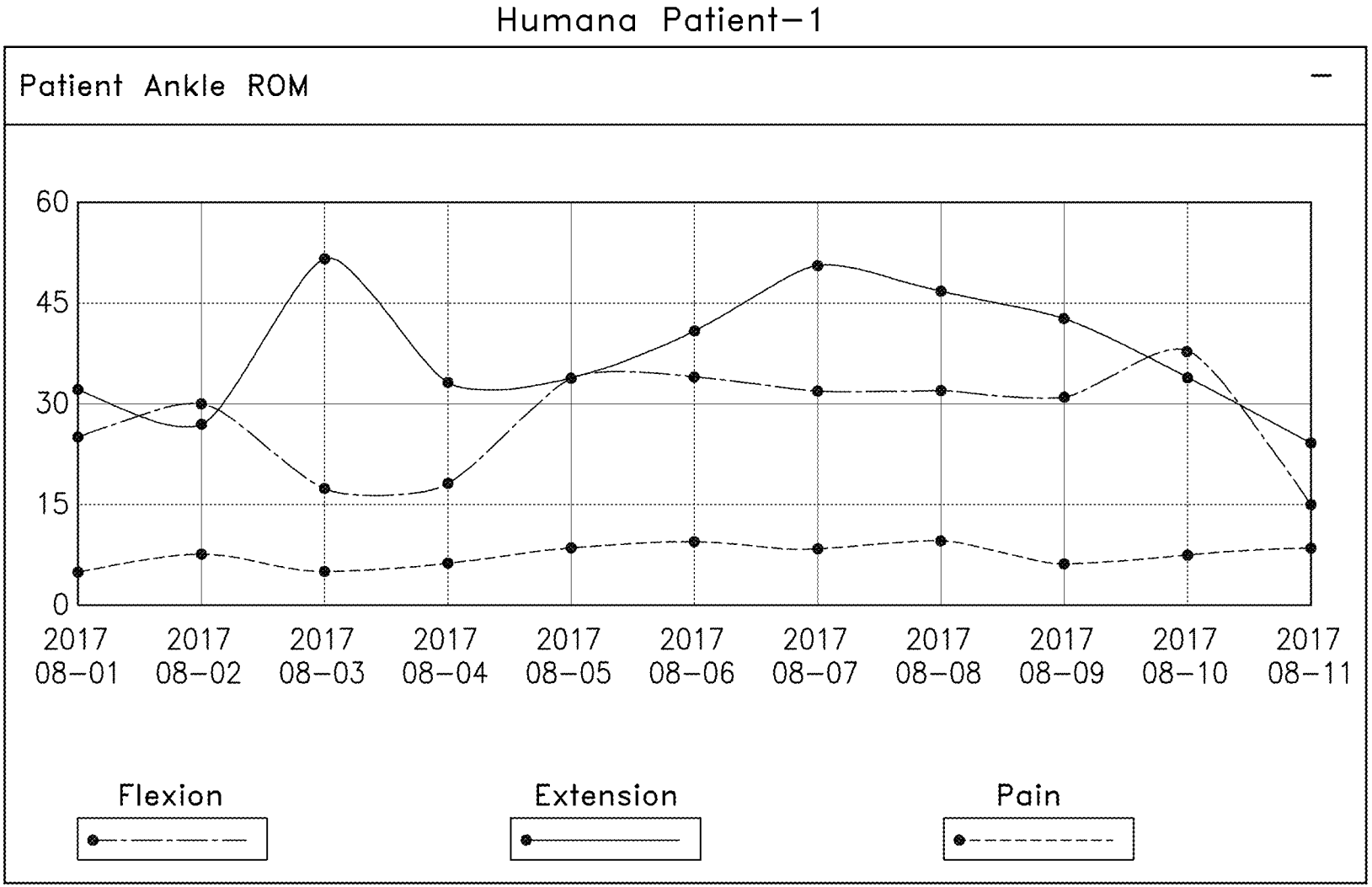
FIG. 11B is a web-based chart showing patient 1's ROM (range of motion) for his ankle.
Figure 11C:
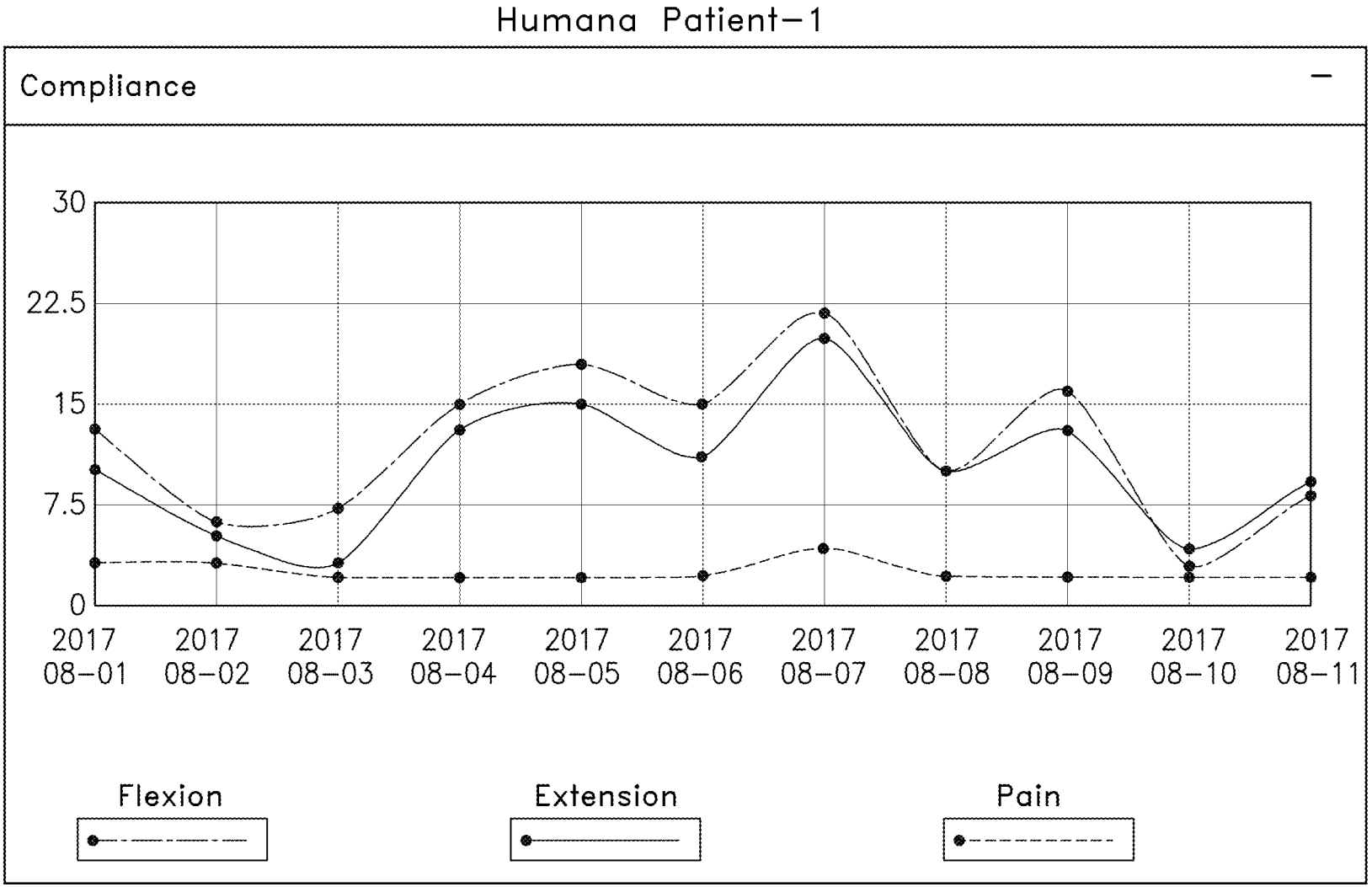
FIG. 11C is a web-based patient on compliance.

FIGS. 11A-11C show various charts and graphs of a patient's progress for usage, pain, range of motion, patient ankle ROM and compliance. FIG. 11A shows usage, pain and range of motion graphs for a particular patient. FIG. 11B is a patient ankle ROM graph over several sessions. FIG. 11C is a compliance graph for those sessions.

FIGS. 12A-12B show charts and session information. FIG. 12A shows a treatment calendar with treatment information. FIG. 12B shows a listing of exercise sessions.

FIG. 13 is a detail of a patient's sessions showing protocol name, date, duration, reps, flexion achieved, flexion goal, horizontal and abductor position and type.

FIG. 14 is a screen showing a patient protocol type with data for protocol name, start and end date, current end range, end range goal, hold time, rest time, reps, speed and estimated duration.

FIG. 15. Outlines the web-server functionality that facilitates the automated capture and logging of clinician time, revisions and updates to the Patient database. This facilitates the automated generation of industry standard Subjective, Objective, Assessment, Plan (SOAP) notes which can be emailed or displayed to the Patient's physician or administrator.

FIG. 16 is the automatically generated Subjective, Objective, Assessment and Plan (SOAP) note created by the system to be emailed or printed for the physician.

Figure 17:
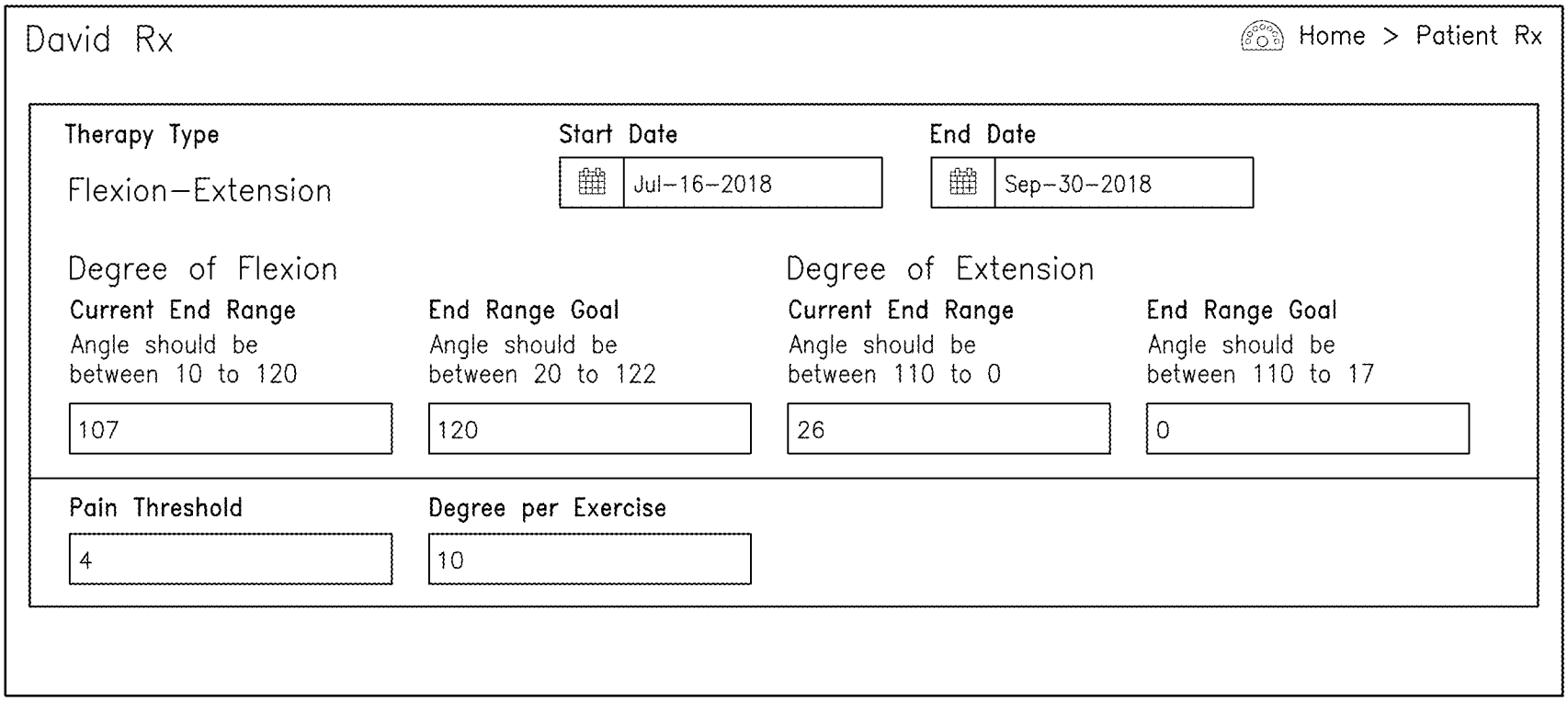
FIG. 17 is an Prescription (Rx) definition and entry screen.

FIG. 17 is a web-server screen allowing creation and editing of the Patient's Prescription (Rx). It allows setting a valid start and end date, starting and end goal ranges of motion, a starting Pain Tolerance agreed upon with the patient that allows for automated responses on the 112 controller, and a Degrees per Exercise setting which is used to automate the safe range of motion allowable per exercise.

FIG. 1 shows a first embodiment of an end range of motion improving device 100. Particularly, the end range of motion improving device 200 includes a frame 202, a first link member 204, a second link member 206, one or more actuators 208, a controller module 111, and a controller 112. More particularly, the first link member 204 is configured for being secured to an upper leg of a patient and configured for rotating the upper leg of the patient about a hip axis of the patient through a predetermined upper leg range of motion, the second link member 206 is configured for being secured to a lower leg of the patient and for rotating the lower leg of the patient about a knee axis of the patient through a predetermined lower leg range of motion. Further, the one or more actuators 208 are configured to rotate the first link member 204 about the hip axis and to rotate the second link member 206 about the knee axis. The first link member 204 and the second link member 206 are configured to rotate independently of one another. However, in certain embodiments, the first link member 204 and the second link member 106 may rotate concurrently. "Link member" as used herein may also be described as a "leg assembly".

For example, FIG. 2 shows the end range of motion improving device 200 being used by a patient. More particularly, FIG. 2 shows a hip axis 214 of the patient anatomically aligning with a first link member axis 220, and a knee axis 216 of the patient anatomically aligning with a second link member axis 222. The hip axis 214 and the knee axis 216 are generally coaxial or parallel, and the first link member axis 220 and the second link member axis 222 are substantially coaxial or parallel. The first link member is secured to the upper leg 224 via an upper leg securing mechanism 228, and the second link member is secured to the lower leg 226 via a lower leg securing mechanism 230. For example, the upper leg securing mechanism 228 and the lower leg securing mechanism may support the upper leg 224 and the lower leg 226 respectively such that when the first link member 204 and the second link member 206 rotate, respectively, the upper leg 224 rotates about the patient hip axis 214 and/or the lower leg 226 rotates about the knee axis 216 of the patient 150. For example, the upper leg securing mechanism 228 and the lower leg securing mechanism 230 may include various pads and straps to secure limbs of the patient. Further, the upper leg securing mechanism 228 and the lower leg securing mechanism 230 may include various adjustment means to adjust height or width to provide comfort to a patient and to anatomically match the various rotational axes as described herein. More particularly, the upper leg securing mechanism 228 and the lower leg securing mechanism 230 may include a concave pad with a semi-spherical cross section. The lower leg securing mechanism 230 may include a footplate that includes adjusting means to a control, guide or limit plantar and dorsiflexion of the ankle. Further, upper leg securing mechanism and lower leg securing mechanism may be configured to limit knee varus or valgus rotation when the upper leg 224 or lower leg 226 is rotated.

The one or more actuators 208 may be configured in various ways to actuate and rotate the first link member 204 and the second link member 206. For example, the one or more actuators 208 may be linear actuators of various appropriate stroke lengths. For example, the one or more actuators 208 may be TiMotion or Geming® brand 4" or 8" industrial linear actuators. To rotate the link members, the one or more actuators 208 and the link members may be connected or attached in various ways. For example, the first link member 204 may be pivotably attached to the frame 202 to form the first link member axis 220. First actuator 232 may be pivotably attached to the frame and to first end 136 of the first link member such that the first link member 204 may pivot about the first link member axis 220 when the first actuator 232 lengthens or shortens.

The second link member 206 may be pivotably attached or linked to a second end 238 of the first link member 204 that is opposite the first end 236. The second link member 206 may be linked to the first link member 204 via a member link 240. Member link 240 may include a hinge plate, or various housing elements. The member link 240 may be a gear system, or a hinge system, for example. Member link 240 has a gear system 242. Particularly, gear system 242 may include various polycentric and/or non-polycentric gears to imitate or provide anatomical rotation similar to that of a human knee. For example, an appropriate polycentric gear system 242 may include planetary gears positioned adjacent to or meshed with a set of sun gears when the second actuator 234 causes the member link 240 to rotate via applying linear force to appendage 244, where appendage 244 acts as a lever. Any appropriate number of teeth may be included in the various gears in the gear system 242. For example, less teeth may produce a greater degree of travel for any one of the gears, with less actuator motion. For example, the planetary gears and the sun gears may have a same number of teeth. One or more potentiometers may be included in gear system 242 such that voltage readings may be obtained for gear rotation angles, and such voltage readings may be recorded as usage data. Including gears with more teeth may provide finer voltage sensing. Gear system 242 and one or more actuators 208 may include any appropriate force and/or angle sensors that output sensor data to control module 110 for processing. Further, such force and/or angle sensors may be included in the upper leg securing mechanism or the lower leg securing mechanism. For example, force and/or angle sensors may be included in a pad that engages a user's leg. Turning back to FIG. 2, a second actuator 234 may be pivotably attached to the first link member 204 and the second link member 206 such that when the second actuator lengthens or shortens, the second link member rotates about the second link member axis 222. The second link member axis 222 may be formed by member link 240 or by any appropriate rotational linkage means at second end 238. For example, member link 240 may include an appendage 244 where the second actuator 234 may be pivotably attached such that the member link 140 acts as a lever to rotate the second link member 206 when the appendage 244 is rotated via the lengthening or shortening of the second actuator 234. Appendage 244 take form as a lever arm or a lever.

The end range of motion improving device 200 includes various adjustment or comfort means to anatomically match the first link member axis 220 and the second link member axis 222 with patient hip axis 214 and knee axis 216, respectively. For example, first link member 204 may include a first adjustment means 246 to elongate or shorten the first link member 204 to adjust and anatomically match the first link member axis 220 with the hip axis 214, and the second link member axis 222 with the knee axis. For example, the first link member may include a telescoping shaft with various holes that a plunger may engage to selectively secure an effective length of the first link member. Similarly, the second link member may include a second adjustment means 248 to adjust to a tibial length or a lower leg 226 length such that the knee axis 216 anatomically matches the second link member axis 222 when a patient's leg is strapped or secured to the second link member 206. Further, a seat 250 may be attached to the frame 202 such that the seat 250 may be adjusted for patient comfort or most importantly to anatomically match the hip axis 214 and the knee axis 216 with the first link member axis 220 and the second link member axis 222. For example, seat 250 may include a seat adjustment means 252 to change a seat-to-backrest angle so that a patient's hip-to-lower leg angle may be adjusted. Further, for amputee support, various modifications may be made to second link member 206 such as to adjust and attach the lower leg securing mechanism 230 to holes 254 such that a below-knee amputee patient may secure rotate their lower leg using the disclosed device.

Base 256 may take any appropriate form to provide stability and support for frame 202 and patient 150. Further, base 256 may include wheels 258 such that the frame 202 may be conveniently transported across a surface on which the frame 202 rests. Further, frame 202 may include various arm rests to provide comfort, or to provide a surface for controller 112 to be conveniently placed. It is to be understood that frame 202 may be assembled to provide therapy to any leg of a patient.

The one or more actuators may be driven to rotate, manipulate, or articulate respective limbs of a patient in response to a manual or automatic controller or control module input. For example, the controller 112 is shown in FIG. 2 receiving a user input. FIG. 2 shows controller 112 in more detail. For example, controller 112 is shown as an android tablet that includes a display 160 that displays various usage data, parameters, instructions or indicators relating to usage of the end range of motion improving device 200. For example, usage data may include time using the end range of motion improving device 200, sensed force data applied from or to the limbs of a patient, maximum and minimum angles reached via flexion, extension or hip rotation, time a patient holds a particular angle such as a maximum or minimum angle, and/or number of cycles completed of a particular therapy exercise. Further, controller 112 includes various user input means. For example, controller 112 may include a touch screen LCD display to provide user input, or may include various tactile, physical, and mechanical buttons. As a non-limiting example, controller 112 includes a selector. Selector is configured such that the patient 150 or a user is able to select whether they want to rotate their upper leg 224 or their lower leg 226 while secured to the end range of motion improving device 200. First button and second button may be used to rotate the selected leg portion (i.e. upper leg or lower leg) via extension or flexion respectively, or as indicated by display 160 of controller 112. For example, the patient 150 may select "knee" then choose to rotate their lower leg about the knee axis 216. Likewise, the patient 150 may select "hip" then choose to rotate their upper leg about the hip axis 214. The controller 112 is wired and/or configured such that patient 150 may choose to rotate their upper leg 224 or lower leg 226 independently. Alternatively, controller 112 may act as a means to allow a user or patient 150 to rotate both the upper leg 224 and the lower leg 226 concurrently in any desired rotation direction (i.e. flexion or extension). The controller 112 allows a user to rotate the respective limbs by sending a signal via controller module 111 to rotate first link member 204 and/or second link member 206. It is to be understood that controller 112 may include variations in its user interface. A computer processor is included in controller module 111, the computer processor may include a storage machine holding instructions executable by a logic machine, the instructions being any appropriate computer readable instruction indicated, mentioned or described herein.

Controller module 111 includes means to provide controller 112 with readout information about the end range of motion improving device 200. For example, the end range of motion device 200 may include various sensors 400, 402, or wearable sensors 404 on the patient that provides the controller module and subsequently the controller with information such as current angle, acceleration, and force data related to forces applied to a patient's limb or forces applied to the first link member 204 or the second link member 206 or the first link member axis 220 or the second link member axis 222. Further, the controller may be provided with sensor information relating to angle. For example, the controller may display angle readout information for current angles of first link member 204 and the second link member 206. Further, controller module 111 may include means to connect controller module 111 to a network such that the controller module 111 may receive computer instructions from the network, may be controlled remotely via a remote device, or may upload or send usage report data to a server on the network for further processing. For example, controller module 111 may be connected to a computer network such that the controller module 111 and controller 112 may be shut down, controlled, or rotation parameters may be adjusted or inputted. Further, a current location of the end range of motion improving device 200 may be determined or uploaded via the computer network. For example, controller module 111 may receive input control signals or parameters locally or remotely to automatically cycle rotating first link member 204 or second link member 106 through predetermined rotation limits, or predetermined force limits. The controller module 111 may be set to automatically cycle between a range of motion while holding a particular angle for a particular time at various angle increments, while remaining within a certain force threshold. Controller module 111 may be indicated to stop automatically rotating when the controller module 111 is supplied with sensor inputs that pass a predetermined force or rotation threshold. As such, force sensors or rotation sensors may be included to provide force and rotation usage information. Therefore, controller module 111 or end range of motion improving device 200 may include various appropriate computer processors or computer components to provide such features. For example, end range of motion improving device 200 may include various wireless or Bluetooth devices to wirelessly connect controller 112, controller module 111 or any appropriate component to a computer network to provide the functions described herein. Further, controller 112 or controller module 112 may include more than one controller, such as a slave controller hard wired to the end range of motion improving device 200 or a wireless pendant that controls the slave controller or control module 110, the pendant being conveniently locatable in a user's hand. Additionally, controller module 111 or controller 112 may include an "abort" button that disengages rotation if a patient experiences extreme discomfort or injury, or if the end range of motion improving device 200 malfunctions. For example, such an "abort" button may be a user input to send signals to controller module 112 to reverse forces applied to the patient's upper leg or lower leg.

Force and/or angle data may be processed by the end range of motion device 200 to provide various exercise modes to a patient. For example, a patient may be prescribed to engage in isometric exercises. To apply isometric exercise, a patient may be indicated by display 160 or by a physical therapist to apply force via their lower leg or upper leg to the first link member 204 or second link member 206. As such, sensing forced applied by a patient may be used to determine patient strength, or progress.

Further, a patient may be indicated by a health professional to engage in contract relax therapy, where a patient presses against the first link member or the second link member in an opposite direction of link member rotation such that the patient's muscles and tendons increase range of motion and a "stretch reflex" is minimized. For example, during stretching, a leg muscle (e.g. a hamstring) may reflexively apply a force in response to an opposing force.

Such contract relax therapy may reduce such a "stretch reflex", and sensing forces and angles via the various sensors disclosed herein provides this functionality.

Even further, eccentric or concentric exercise may be prescribed to a patient, and such exercises are enabled by the end range of motion device 200 via the force and angle sensors described herein. For example, eccentric exercise may include a patient pressing against the second link member while simultaneously rotating the second link member in an opposite direction to the applied force. On the other hand, concentric exercise may include a patient applying a force to the second link member while rotating the second link member in a same direction of the applied force.

In some embodiments, the end range of motion improving and reporting system may include one or more storage machines holding instructions executable by one or more logic machines to receive a set of parameters, execute an automated cycle based on the parameters to automatically rotate at least one of an upper leg of a patient about a hip axis of the patient and a lower leg of the patient about a knee axis of the patient, record report data, and send the report data to a remote database. The set of parameters includes a maximum angle and a minimum angle. The set of parameters includes a maximum force applied to at least one of the upper leg and lower leg. The set of parameters includes time that at least one of the first and second link members is to spend at a particular angle. The instructions are executable to receive usage data, the usage data including at least one of a current angle of the upper leg and the lower leg, a force value, number of executed cycles, and total running time. The instructions are executable to rotate the upper leg independently about the hip axis without causing the lower leg to rotate about the knee axis, or to independently rotate the lower leg about the knee axis without causing the first link member to rotate about the hip axis. The instructions include to display at least one of the usage data and the set of parameters. The instructions are executable to receive instructions from a remote device via a computer network.

Figure 20:
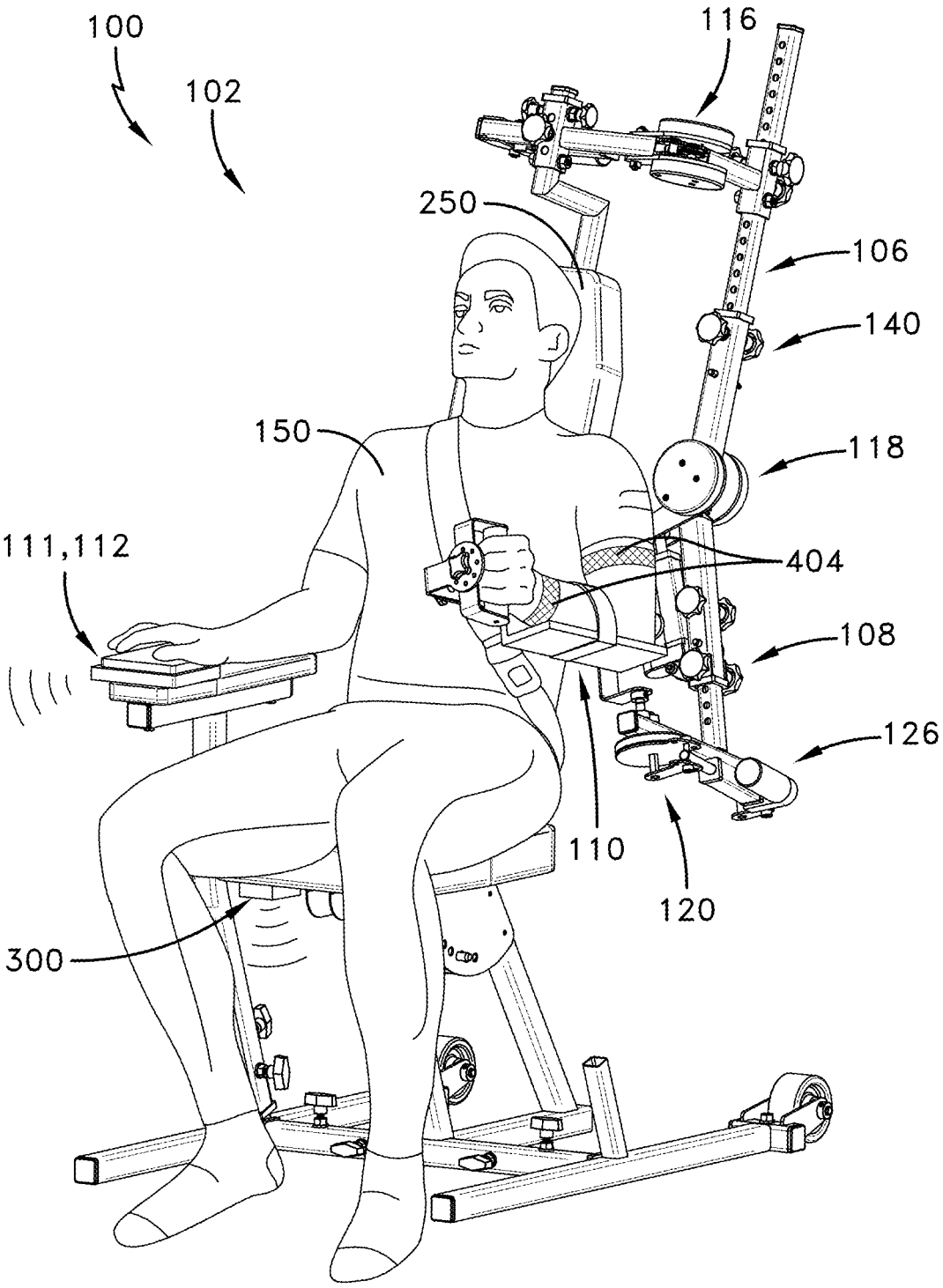
FIGS. 20-24 show a rehab patient using the end range of motion shoulder device using a variety of different arm exercises.
Figure 21:
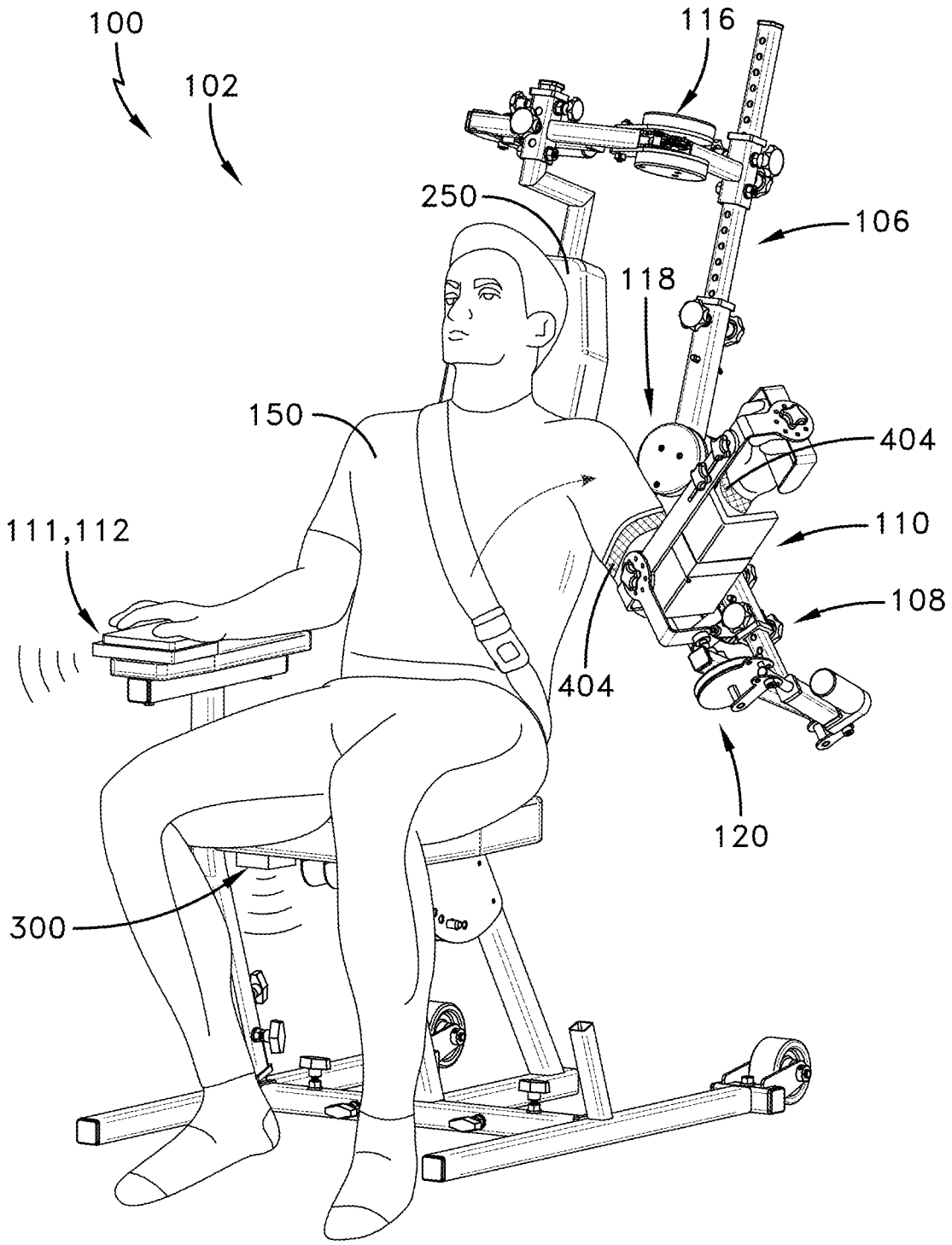
Figure 22:
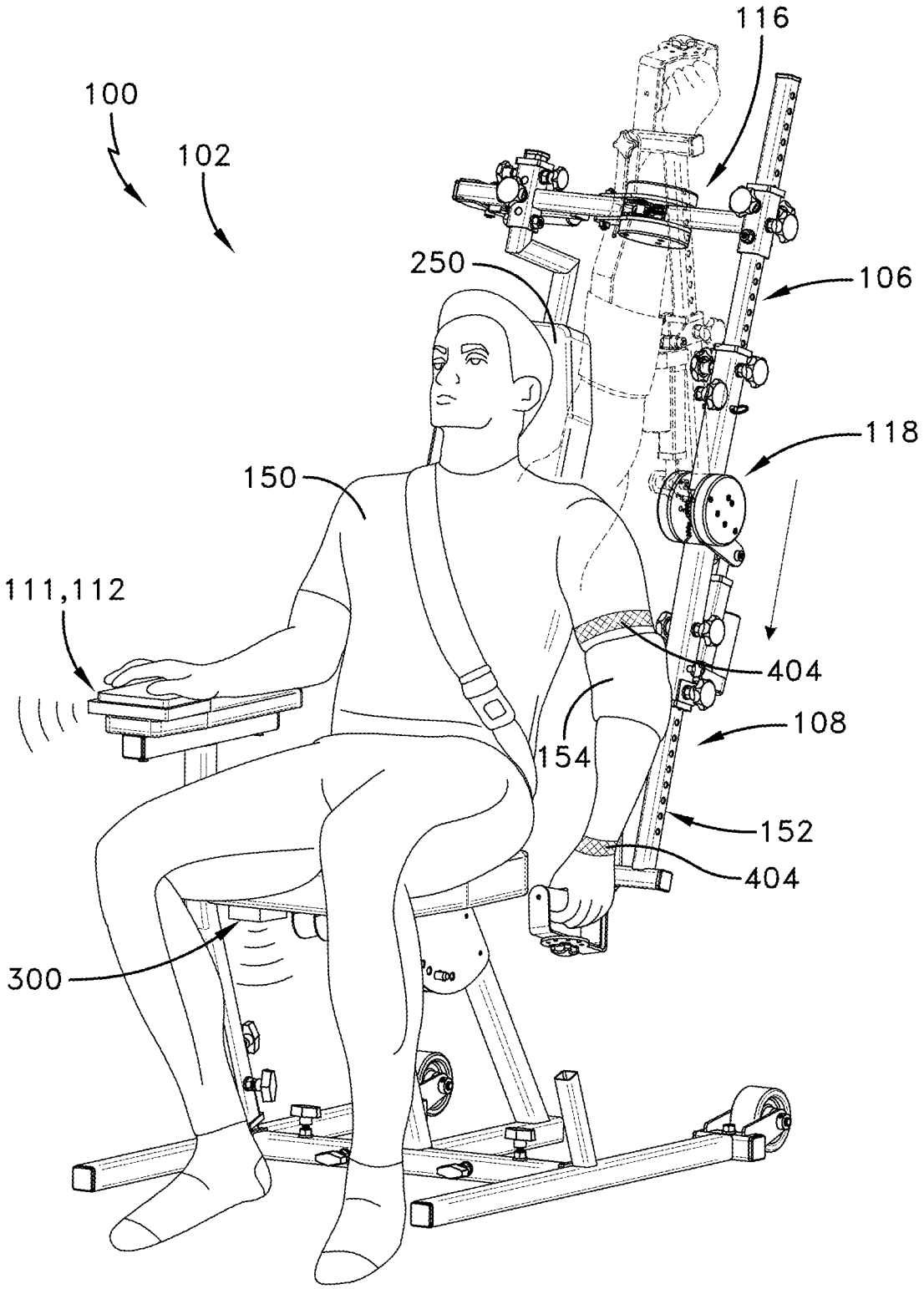
Figure 23:
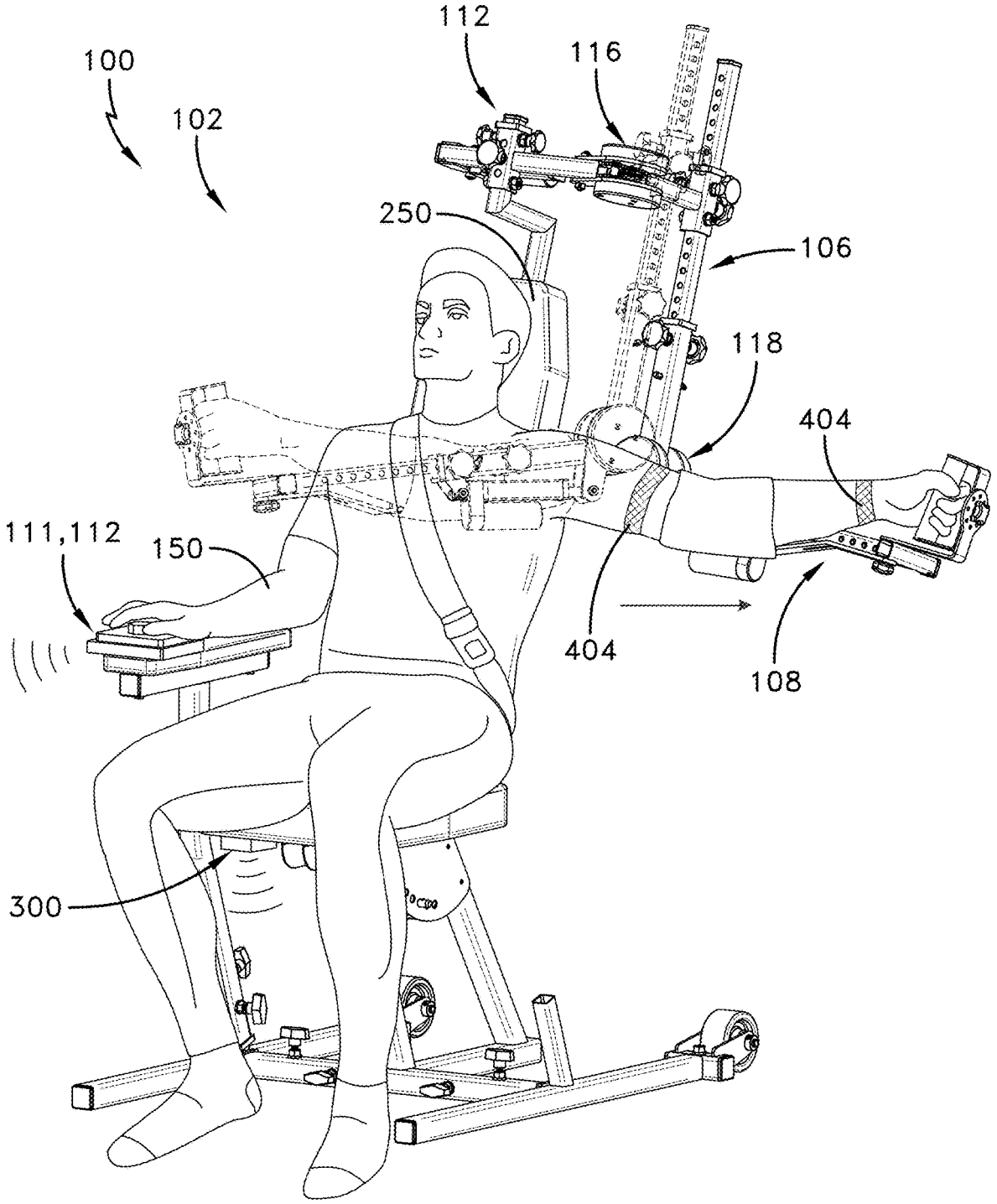
Figure 24:
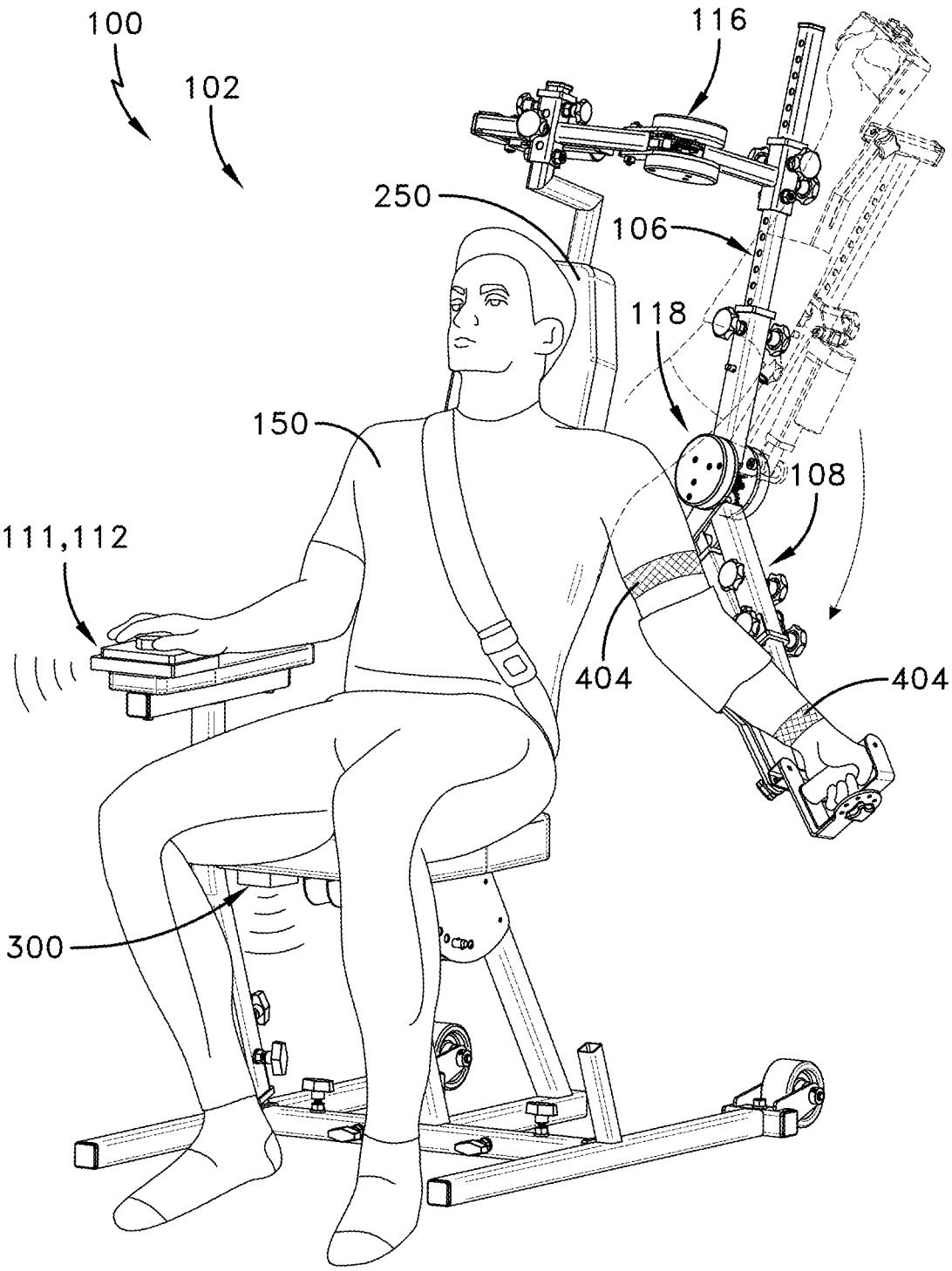

FIGS. 20-24 present a shoulder rehabilitation device 100, as shown in FIG. 20, includes a linkage 102 and a controller 104 for providing end range of motion therapy. The linkage 102 includes a first link member 106, a second link member 108, and a third link member 110. The linkage 102 may be attached to a support 112 which elevates and supports the link members during use. A seat 250 may be included on the support 112 to accommodate a patient. For example, the linkage 102 may be attached in an elevated fashion above the seat 250, or behind the seat 250. The seat 250 may include an adjustment mechanism to adjust an incline angle of the seat 250 (e.g. a backrest angle) during use. More particularly, the linkage 102 may be connected to a backrest of the seat 250, the linkage 102 including a support affixed to said backrest and disposed above the backrest. As such, one or more of the link member axes, such as first link member axis 116 may be disposed above the seat 250 above a patient's shoulder. The first link member axis 116 may provide an axis of rotation aligned with a patient's shoulder, perpendicular to the ground on which the device rests. For example, the first link member axis 116 may be disposed above a patient's shoulder providing an axis of rotation of the first link member 106 about a vertical axis, with motion in a transverse plane. Configuring the linkage 102 in this way (above and/or behind the backrest or seat 250) allows a user's arm to be rotated in a transverse plane (e.g. FIG. 23) across a patient's torso without the patient's leg, the seat 250, or the support 112 interfering with motion of the linkage 102 or link members. Similarly, supporting the linkage 102 above the backrest allows substantial retraction (i.e. horizontal rotation in the transverse plane behind a patient's back) without the linkage touching or contacting the patient, seat or support.

Figure 18:
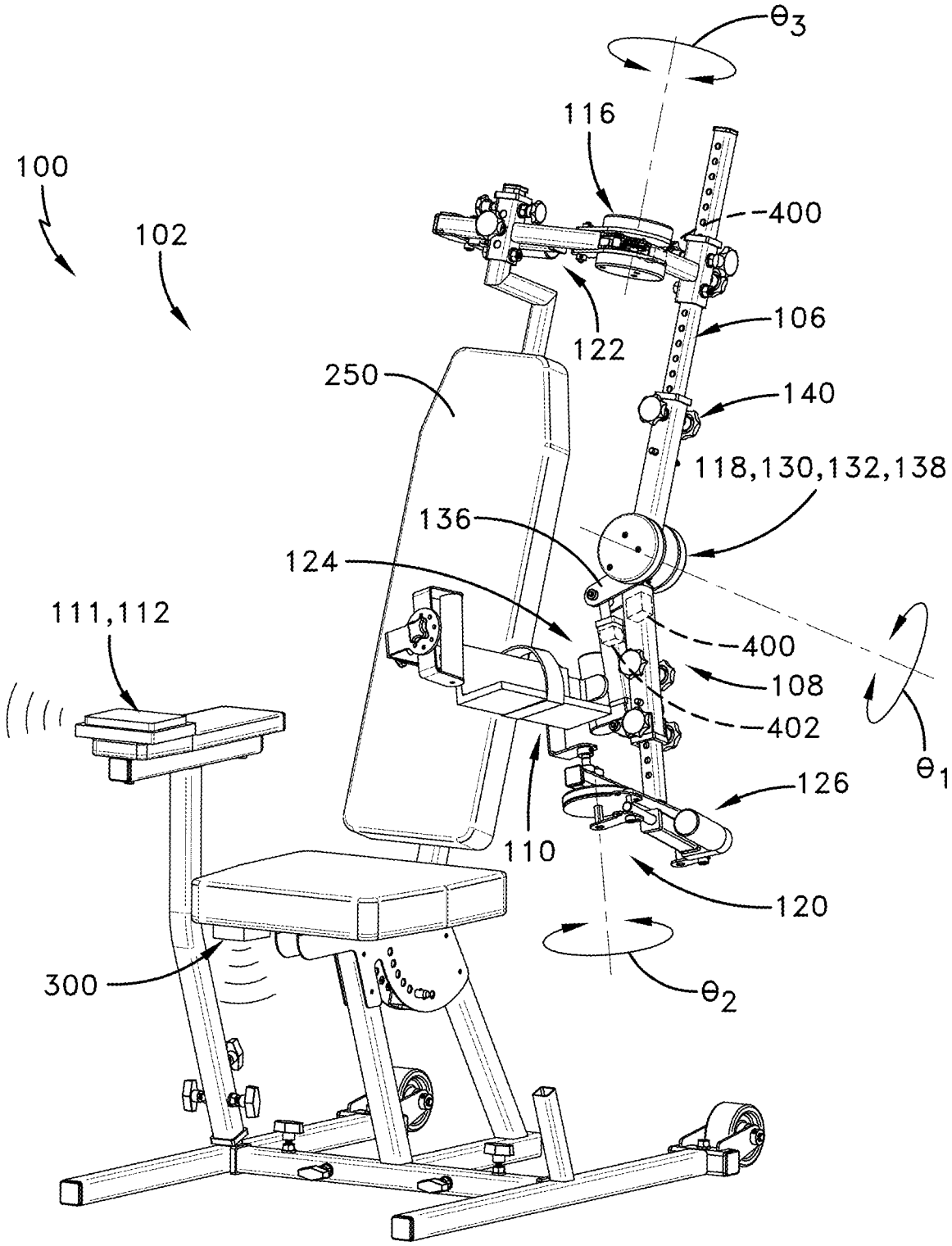
FIG. 18 is a perspective view of a second embodiment of the end range of motion arm device shown attached to the backrest of the seat made in accordance with the present invention.
Figure 19:
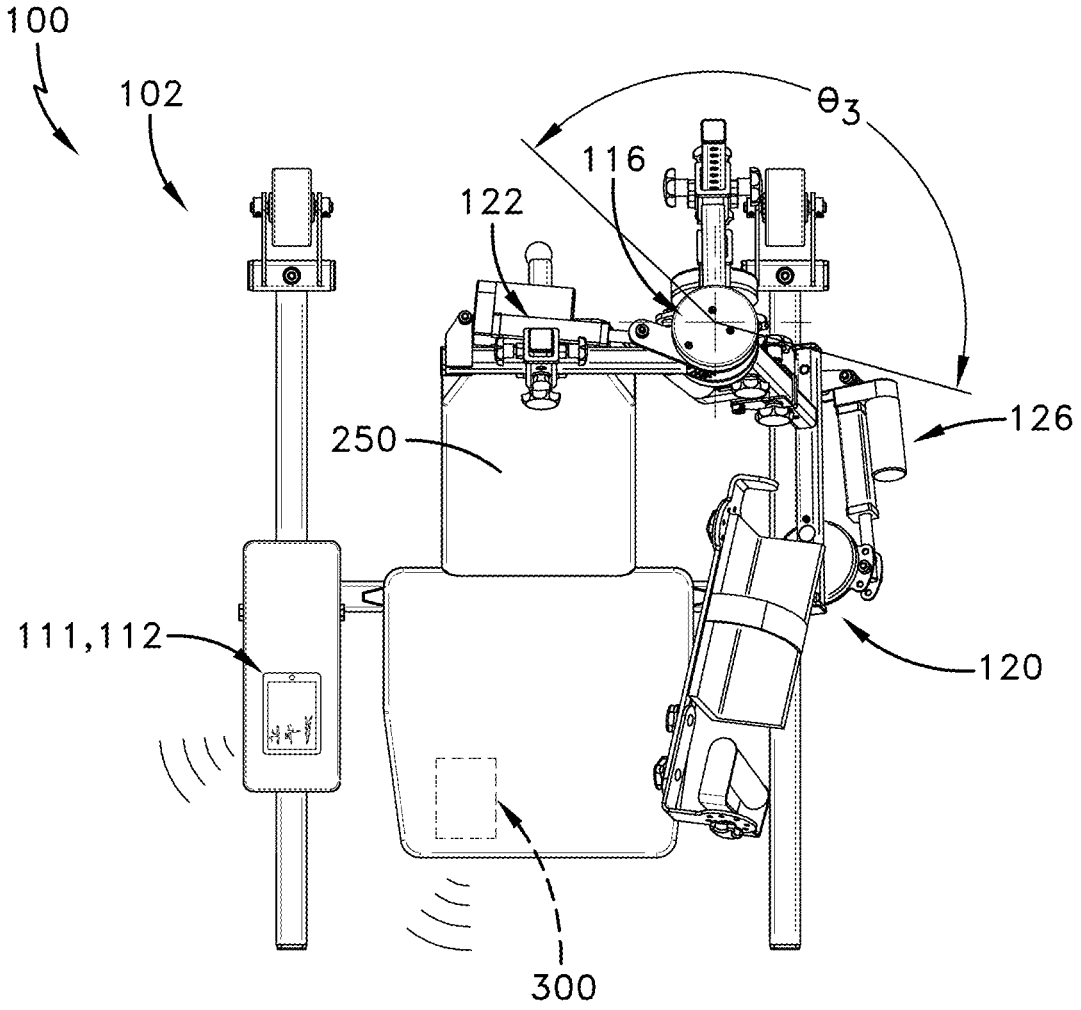
FIG. 19 is a top view of the second embodiment device.

FIGS. 18 and 19 further show one or more actuators and one or more link member axes for rotating a patient's arm about a shoulder joint through an arm range of motion. For example, first link member axis 116 is configured to rotatably attach the first link member 106 to the support 112, second link member axis 118 is configured to rotatably attach the second link member 108 to the first link member 106, and third link member axis 120 is configured to rotatably attach the third link member 110 to the second link member 108. A first actuator 122 is configured to drive the rotation of the first link member 106 about the first link member axis 116, a second actuator 124 is configured to drive the rotation of the second link member 108 about the second link member axis 118, and a third actuator 126 is configured to drive the rotation of the third link member 110 about the third link member axis 120. For example, the one or more actuators may be TiMotion or Geming®. brand linear actuators of any appropriate stroke length. The support or seat 250 may be configured to provide clearance for the link members and actuators to pass behind or in front of the seat 250 or support when the first link member 106 is rotated to horizontally retract (behind torso) or adduct (in front of torso) a patient's arm. Further, the second actuator 124 may be appropriately positioned on the first link member 106 or second link member 108 such that the second actuator 124 does not collide with the seat 250 or the support during rotation of the link members.

The actuators may be positioned on the linkage 102 in various ways. For example, with respect to FIG. 18, second actuator 124 may be positioned or disposed on first link member 106 or second link member 108 to actuate or drive the second link member axis 118 and subsequently rotate the second link member 108. When the second actuator 124 is disposed on the second link member 108, the actuator may run more efficiently or be more aesthetically appealing. For example, when the second actuator 124 is disposed on the second link member 108, the actuator "pushes" or "pulls" the second link member 108 directly, somewhat mimicking natural motion of a human body lifting a weight. Alternatively, when the second actuator 124 is disposed on the first link member 106 for rotating the second link member 108, the second actuator 124 drives the second link member axis 118 and subsequently or indirectly rotates or drives the second link member 108. The second actuator 124 being placed on the second link member 108 may run with less strain, thus prolonging the life of the actuator.

The one or more link member axes may be polycentric gear systems to provide rotation of the link members. FIG. 18 shows an example of such a polycentric gear system 138, where an outer gear 130 rotates about a central gear 132 when actuator 134 rotates lever 136, causing the rotation of link member 108. For example, a first position of the polycentric gear system. The lever 136 may be a hinge plate coupled to the actuator 124 and outer gear 130, and configured to be rotated when the actuator 124 is activated. Such a polycentric gear system 138 anatomically imitates or matches a rotating shoulder joint where the humeral head during arm elevation causes the clavicle to rotate upward. A polycentric hinge may reduce arm migration when an arm is rotated through a range of motion, reducing risk of further injury. In some cases, it is preferred that the head of a patient's humerus is aligned with the central gear 132. Alternatively, the one or more link member axes may be provided by simple hinges.

Turning back to FIG. 18, the link members may include adjustment mechanisms to anatomically match a patient's shoulder joint with the one or more link member axes. For example, first link member 106 may include adjustment mechanism 140. The included adjustment mechanisms may adjust an effective length of the respective link members via an adjustment pin disposed on a tubular member that slides into holes of another member insertable into the tubular member to secure a desired length of a link member.

In some embodiments, the controller 112 may be configured to receive user input, and may include a computing system to process information to carry out rotation tasks. For example, the display 160 may be configured to display various usage data, parameters, instructions or indicators relating to usage of the shoulder rehabilitation device 100. Usage data may include time the shoulder rehabilitation device 100 is used, sensed force data applied from or to the arms of a patient, maximum and minimum angles reached from rotation of the link members, user input data, time a particular angle is held, and/or number of cycles completed of a particular therapy exercise. User input may be received via a touch screen LCD display or various tactile or virtual buttons and may include various parameters for the computing system to carry out automatic cycling of rotation, or limit maximum or minimum angles of rotation or forces. For example, the controller may receive input control signals locally or remotely to automatically cycle the rotating of a link member through predetermined rotation limits or predetermined force limits. For example, the link member axes or the link members may include force sensors to determine forces involved in the rotation of a patient's arm, or positions or angles of the link members. The display 160 may display angle readout information for current angles of the link members, or current arm motions or positions. The controller 112 may be connected to a network such that the controller 112 may receive computer instructions from the network, may be controlled remotely via a remote device, or may upload or send usage report data to a server on the network for further processing. For example, the controller 112 may be connected to a computer network such that the controller 112 may be shut down or such that rotation parameters may be adjusted or inputted by a doctor or authorized professional. Further, a current location of the shoulder rehabilitation device 100 may be uploaded via the computer network. For example, controller 112 may receive input controls or parameters to remotely or locally automatically cycle rotating one or more of the link members through predetermined rotation limits, or predetermined force limits. The controller 112 may be set to automatically cycle between a range of motion while holding a particular angle for a particular time at various angle increments while remaining within a certain force threshold. The controller may automatically stop rotating when the controller 112 is supplied data indicating the passing of a predetermined force or rotation threshold. The controller may include various wireless or Bluetooth communication devices to wirelessly connect to the computer network or personal computing devices such as mobile phones. Further, the controller 112 may include more than one controller, such as a slave controller hard wired to the shoulder rehabilitation device 100 or a wireless pendant that controls the slave controller, the pendant being conveniently locatable in a user's hand or affixed to their wrist or limbs. Additionally, the controller may include an "abort" button or function that disengages rotation if a patient experiences extreme discomfort or injury, or if the shoulder rehabilitation device malfunctions. Such an abort button may send signals to reverse or stop forces applied to a patient's arm. Force or angle data provided by the various sensors may be processed by the shoulder rehabilitation device 100 to provide various exercise modes to a patient. For example, a patient may be prescribed to engage in isometric exercises. To apply isometric exercise, a patient may be indicated by the display 160 or by a physical therapist to apply force via their arm to one of the link members to determine a patient's strength or progress. Further, a patient may be indicated by a health professional to engage in contract relax therapy, where a patient presses against a link member in an opposite direction of link member rotation such that the patient's muscles and tendons increase range of motion and a "stretch reflex" is minimized Such contract relax therapy may be provided via sensing forces and angles via the various sensors mentioned above. Further, eccentric or concentric exercise may be prescribed to a patient. For example, eccentric exercise may include a patient pressing against a link member while simultaneously rotating the link member in an opposite direction to the applied force. On the other hand, concentric exercise may include a patient applying a force to a link member while rotating the link member in a same direction of the applied force.

FIGS. 20-24 show a sequence of a patient 150 using the shoulder rehabilitation device 100 by operating controller 112 and securing a link member to an arm of a patient. For example, a link member may be secured to arm of patient 150 via a strap and an arm support.

To further describe some of the motions in FIGS. 20-24, forward flexion and extension may describe motion performed about a frontal axis of the shoulder joint with motion in a sagittal plane. Abduction and adduction may describe motion performed about a sagittal axis of the shoulder joint with motion in a frontal plane. Horizontal abduction and horizontal adduction may describe motion performed about a vertical axis with motion in a transverse plane. Internal rotation and external rotation may describe motion performed where a person's upper arm rotates inward or outward about an axis extending along the upper arm through the shoulder joint.

It is to be understood that the rotation of one link member or rotatably driving one link member axis may cause another link member axis to displace or pivot, without actually driving the other link member axis. For example, the first link member 106 is rotated about first link member axis 116, causing second link member 108 to pivot substantially about the first link member axis 116 without causing the second link member 108 to rotate about the second link member axis 118. As such, the link members may each rotate independently from one another (via respective link member axes), even though rotating one link member may displace an orientation of another link member axis. In this way, by rotating one link member axis, another link member axis can be displaceable or re-oriented into a selectable fixed position. Further, one or more or all of the link member axes may be aligned with a shoulder joint of a patient during any motion or position. Further, although only some angles are shown in the figures, it is to be understood that the shoulder rehabilitation device may hold any link member at any position provided by the link member axes.

In some embodiments, the methods described above may be carried out or executed by a computing system including a tangible computer-readable storage medium, also described herein as a storage machine, that holds machine-readable instructions executable by a logic machine (i.e. a processor or programmable control device) to provide, implement, perform, and/or enact the above described methods, processes and/or tasks. When such methods and processes are implemented, the state of the storage machine may be changed to hold different data. For example, the storage machine may include memory devices such as various hard disk drives or CD or DVD devices. The logic machine may execute machine-readable instructions via one or more physical devices. For example, the logic machine may be configured to execute instructions to perform tasks for a computer program. The logic machine may include one or more processors to execute the machine-readable instructions. The computing system may include a display subsystem to display a graphical user interface (GUI) or any visual element of the methods or processes described above. For example, the display subsystem, storage machine, and logic machine may be integrated such that the above method may be executed while visual elements are displayed on a display screen. The computing system may include an input subsystem that receives user input. The input subsystem may be configured to connect to and receive input from devices such as a mouse, keyboard or gaming controller. For example, a user input may indicate a request that certain task is to be executed by the computing system, such as requesting the computing system to display any of the above described information, or requesting that the user input updates or modifies existing stored information. A communication subsystem may allow the methods described above to be executed over a computer network. For example, the communication subsystem may be configured to enable the computing system to communicate with a plurality of personal computing devices. The communication subsystem may include wired and/or wireless communication devices to facilitate networked communication. The described methods or processes may be executed, provided or implemented for a user or one or more computing devices via a computer-program product such as via an application programming interface (API).

Figure 25:
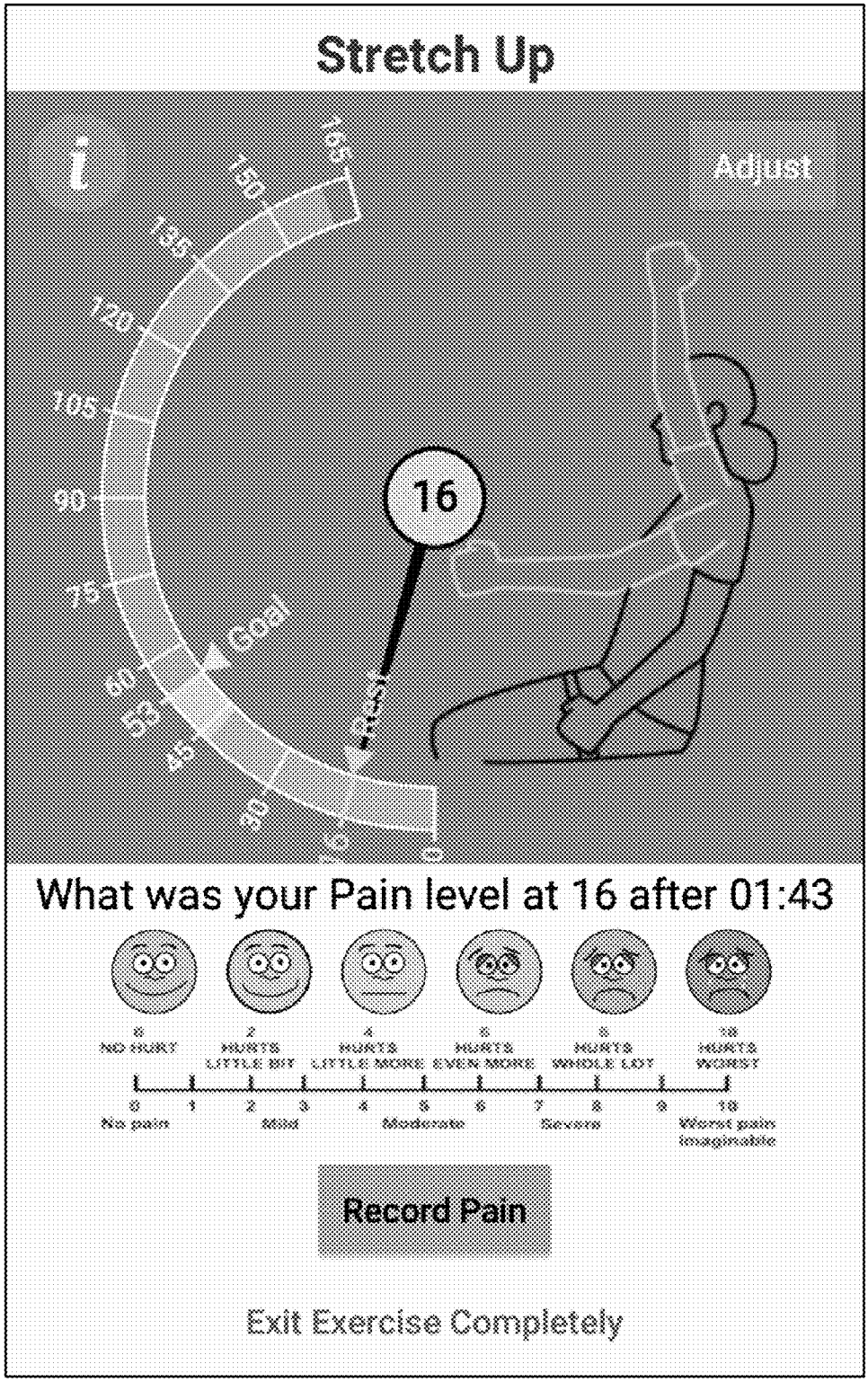
FIGS. 25 and 26 show screen shots from the programmable range of motion system for the user to report pain before, during and after completion of an exercise and remote chat or teleconferencing between the patient and the physician or rehab technician both while the patient is executing an exercise or while not executing an exercise.
Figure 26:
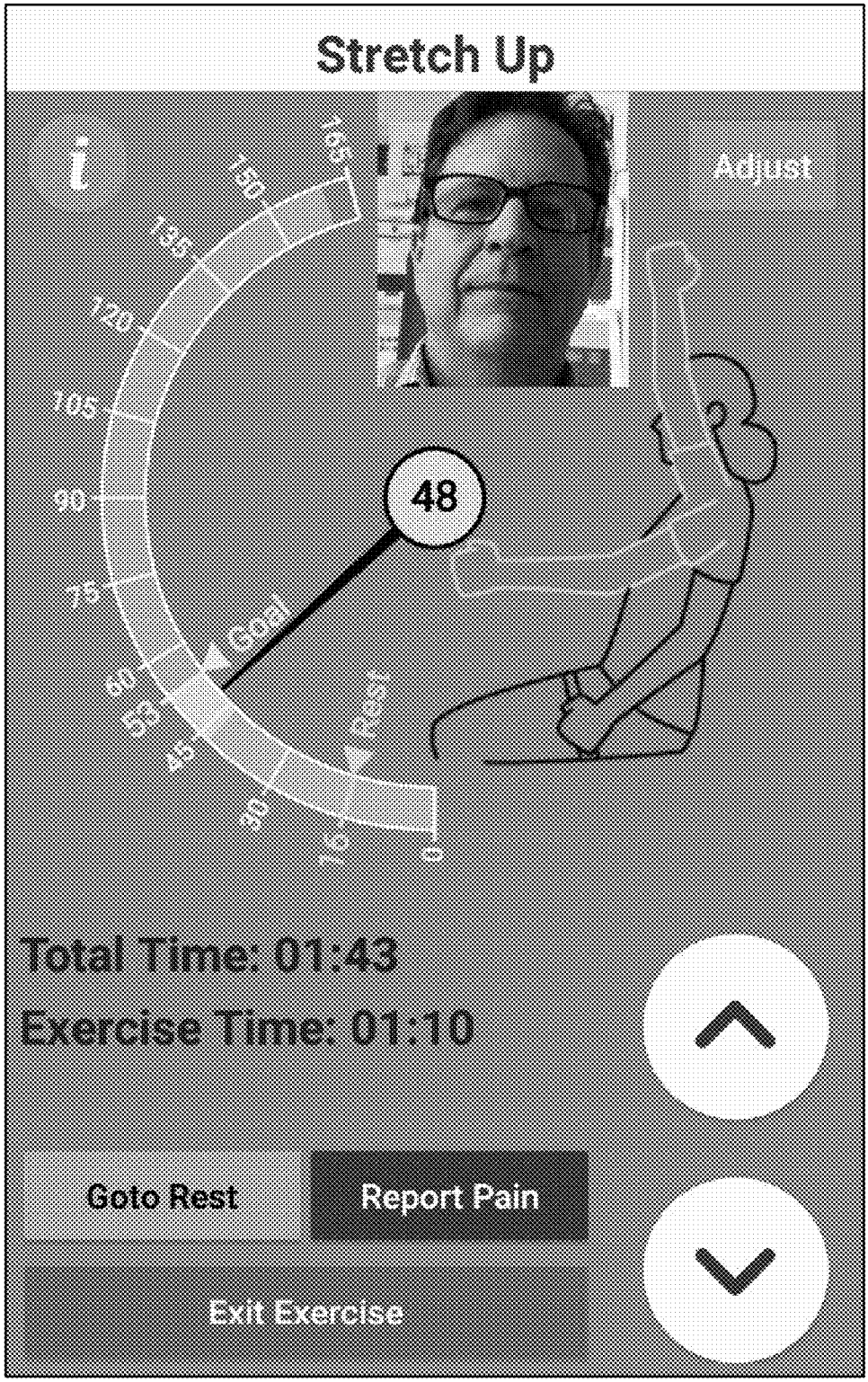

FIGS. 25 and 26 show screen shots from the programmable range of motion system wherein the computer provides a method for the user to report pain before, during and after completion of an exercise. In addition, this pain recorded during an exercise is in context to the specific time, repetition and angle that the patient was executing; allowing the physician, therapist or rehab technician to better understand and resolve the medical issue. The computer system also provides remote chat or teleconferencing between the patient and the physician or rehab technician both while the patient is executing an exercise or while not executing an exercise.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

Variations in the present invention are possible in light of the description of it provided herein. While certain representative embodiments and details have been shown for the purpose of illustrating the subject invention, it will be apparent to those skilled in this art that various changes and modifications can be made therein without departing from the scope of the subject invention. It is, therefore, to be understood that changes can be made in the particular embodiments described which will be within the full intended scope of the invention as defined by the following appended claims.

What is claimed is:

1. A programmable end range of motion system for a leg comprises:

a frame having a seat adjustably mounted on the frame configured to support a rehab patient, a plurality of legs elevating the seat above a floor and one or more frame attachment locations for receiving one or more range of motion improving devices;

a first end range of motion improving device for attachment to a patient's leg, the first end range of motion improving device attached to the frame, a leg linkage connected to said frame, the leg linkage including a support affixed to said frame at one of said attachment locations;

a leg linkage, the leg linkage including:

a first link member;

a second link member supported on the first link member, the second link member configured for being secured to a lower leg of the patient and being rotatable about a second link member axis for rotating the lower leg of the patient about a knee axis of the patient through a lower leg range of motion, the second link member axis being displaceable into a selectable fixed position aligned with the knee axis and maintaining the fixed position during rotation of the second link member;

the first link member being independently rotatable about a first link member axis without causing the second link member to rotate about the second link member axis, and the second link member being independently rotatable about the second link member axis without causing the first link member to rotate about the first link member axis;

a leg actuator for rotating the second link member about the second link axis;

a controller controlling the leg actuator for selectively rotating the second link member about the second link axis through the lower leg range of motion or the arm actuator;

a computer connected electronically to the controller, the computer having a software, program or application including a plurality of programmable range of motion movements for exercising the limb; and a sensor to detect movements of the actuator and record data back to the computer.

2. The programmable range of motion system of claim 1 wherein the computer is a phone or tablet or small portable device.

3. The programmable range of motion system of claim 1 wherein the computer has a touch screen.

4. The programmable range of motion system of claim 1 wherein the computer has internet connectivity.

5. The programmable range of motion system of claim 1 wherein the computer can be wired or wirelessly connected to the controller.

6. The programmable range of motion system of claim 1 wherein a physician can prescribe rehab exercises in the form of a prescription for the rehab patient and transmit the prescription to the computer.

7. The programmable range of motion system of claim 1 wherein each patient is provided a secure ID for accessing the computer software, program or application.

8. The programmable range of motion system of claim 7 wherein the patient has operating control for the range of motion device through the computer.

9. The programmable range of motion system of claim 1 wherein the computer software, program or application provides a plurality of screen displays, one screen display showing the range of motion in real time, one screen display providing patient pain levels indications inputtable by the patient, one screen display showing the exercise completion performance.

10. The programmable range of motion system of claim 1 wherein the software, program or application provides a neutral or at rest position for the range of motion device.

11. The programmable range of motion system of claim 1 wherein the software, program or application provides an entry ingress or egress position to facilitate attaching or detaching the range of motion device to the limb.

12. The programmable range of motion system of claim 1 wherein the software, program or application has a built-in range of motion safety override to prevent limb damage.

13. The programmable range of motion system of claim 1 wherein the computer provides remote chat or teleconferencing between the patient and the physician or rehab technician both while the patient is executing an exercise or while not executing an exercise.

14. The programmable range of motion system of claim 1 wherein the computer provides a method for the user to report pain before, during and after completion of an exercise, this pain recorded during an exercise is in context to the specific time, repetition and angle that the patient was executing; allowing the physician, therapist or rehab technician to better understand and resolve the medical issue.

* * * * *